United States Patent [19]

Chung et al.

[11] Patent Number: 4,631,901

[45] Date of Patent: Dec. 30, 1986

[54] APPARATUS AND METHOD FOR PACKAGING A PRODUCT IN INDIVIDUAL PACKETS

[75] Inventors: Yun H. Chung; Dennis E. Chung, both of Maumee, Ohio

[73] Assignee: MPR Corporation, Toledo, Ohio

[21] Appl. No.: 573,492

[22] Filed: Jan. 24, 1984

Related U.S. Application Data

[63] Continuation-in-part of Ser. No. 450,275, Dec. 16, 1982, Pat. No. 4,545,180.

[51] Int. Cl.[4] ..... B65B 9/08; B65B 43/10; B65B 47/00; B65B 7/06

[52] U.S. Cl. ..... 53/455; 53/469; 53/479; 53/562; 53/563; 53/373

[58] Field of Search ..... 53/455, 469, 473, 479, 53/481, 562, 563, 371, 372, 373, 266 P; 383/104, 122; 206/604

[56] References Cited

U.S. PATENT DOCUMENTS

| | | | |
|---|---|---|---|
| 2,329,360 | 9/1943 | Salfisberg | 206/604 X |
| 2,691,259 | 10/1954 | Weckesser | 53/563 X |
| 2,691,857 | 10/1954 | Harker | 53/373 |
| 2,751,732 | 6/1956 | Woppman | 53/373 X |
| 2,754,644 | 7/1956 | Vergobbi et al. | 53/562 X |
| 2,885,846 | 5/1959 | Harker | 53/562 X |
| 3,057,129 | 10/1962 | Meissner | 53/479 X |
| 3,382,644 | 5/1968 | Vogt | 53/469 X |
| 3,930,350 | 1/1976 | Reid | 53/455 X |
| 4,216,639 | 8/1980 | Gautier | 53/455 X |

*Primary Examiner*—Horace M. Culver
*Attorney, Agent, or Firm*—Marshall & Melhorn

[57] ABSTRACT

The present invention relates to a unique method for packaging a product in individual packets constructed of a sheet of flexible material. In the method of the present invention, a sheet of flexible packaging material is formed into a generally U-shaped channel having spaced apart vertical sidewalls. The facing surfaces of the sidewalls are sealed at horizontally spaced apart locations to define a plurality of open top packets. A predetermined amount of a flowable product is introduced into each of the open top packets. Next, the upper corner portions of each individual packet are sealed and a prdetermined portion is cut from each upper corner. The upper corner portions of each packet then are pulled away from one another in a generally horizontal direction to urge the spaced apart upper marginal edges of the sidewalls of the packet toward one another. After the upper corner portions have been pulled away from one another, the upper marginal edges of the packets are sealed together to close the packet. The present invention also concerns an apparatus for packaging a product in individual packets, and a novel packet construction.

27 Claims, 40 Drawing Figures

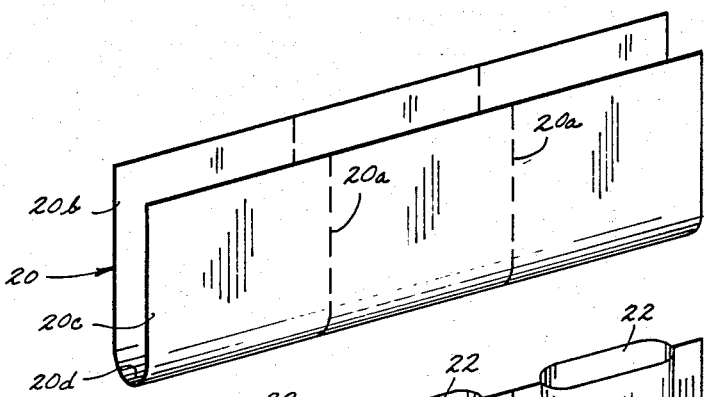
FIG. 2a
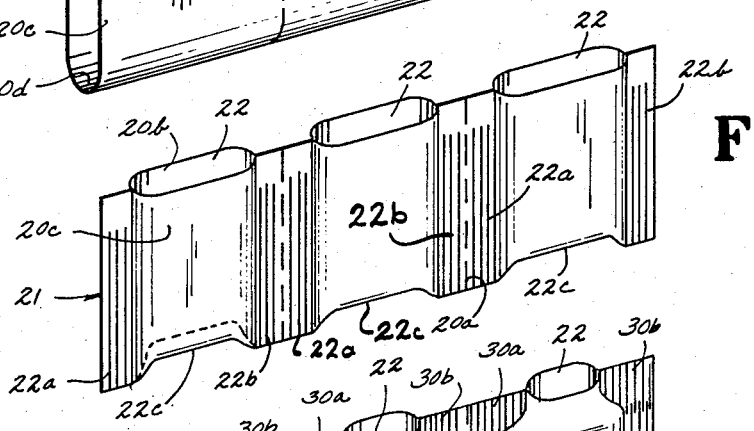
FIG. 2b
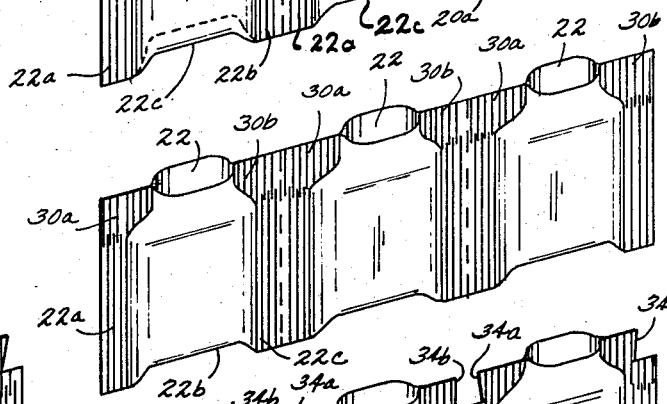
FIG 2c
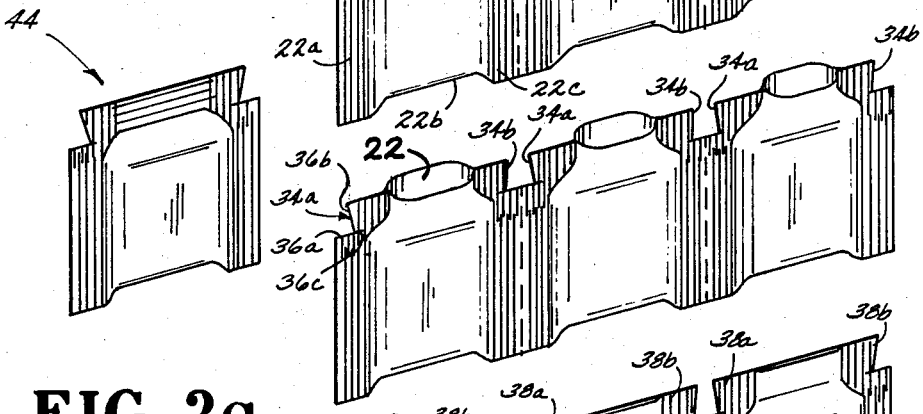
FIG. 2d
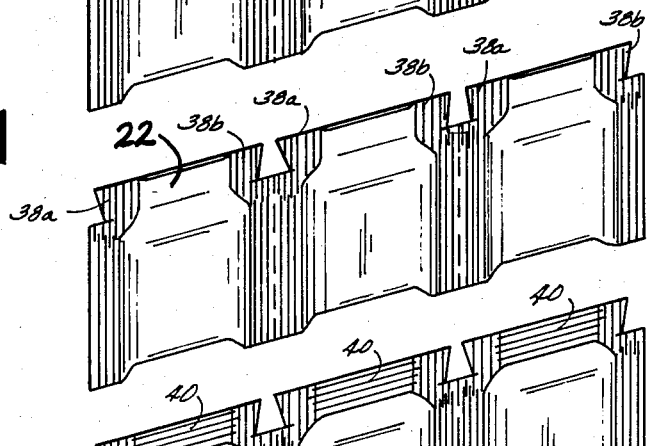
FIG. 2e
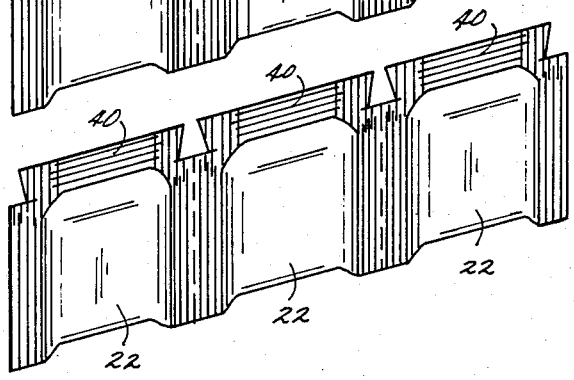
FIG. 2f
FIG. 2g

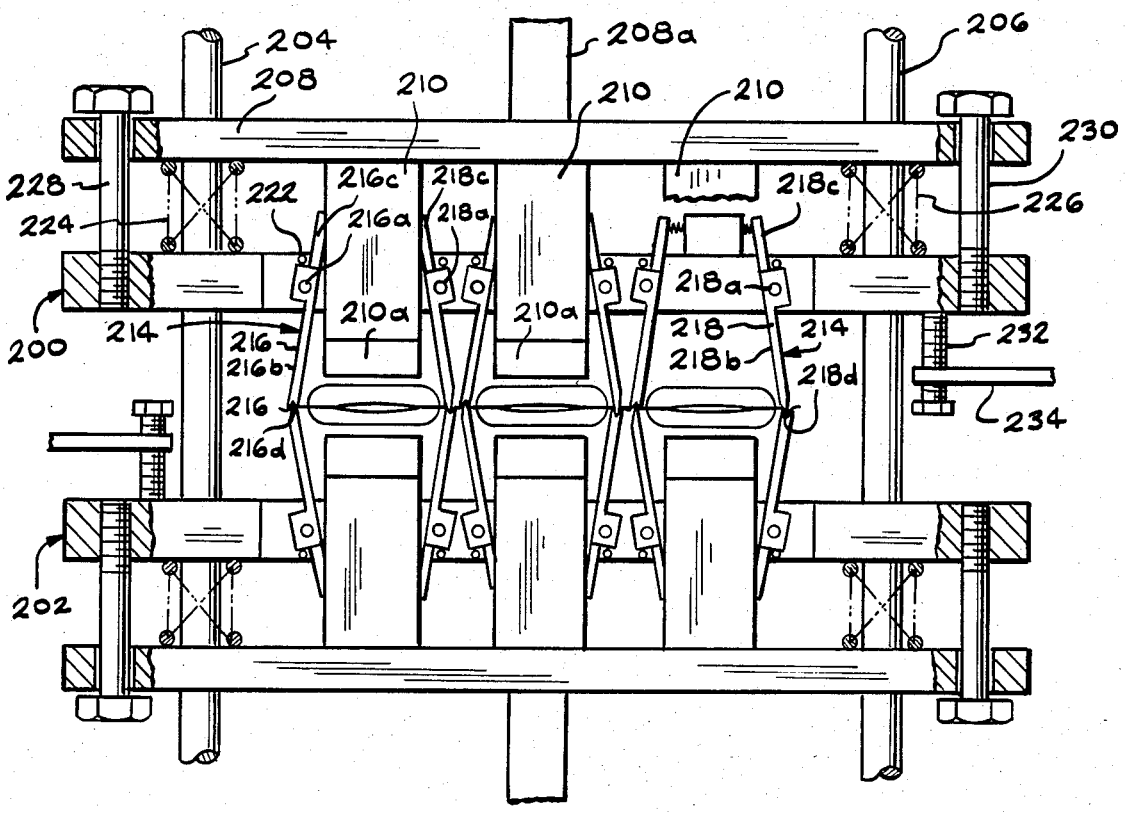
FIG. 9c
FIG. 9d
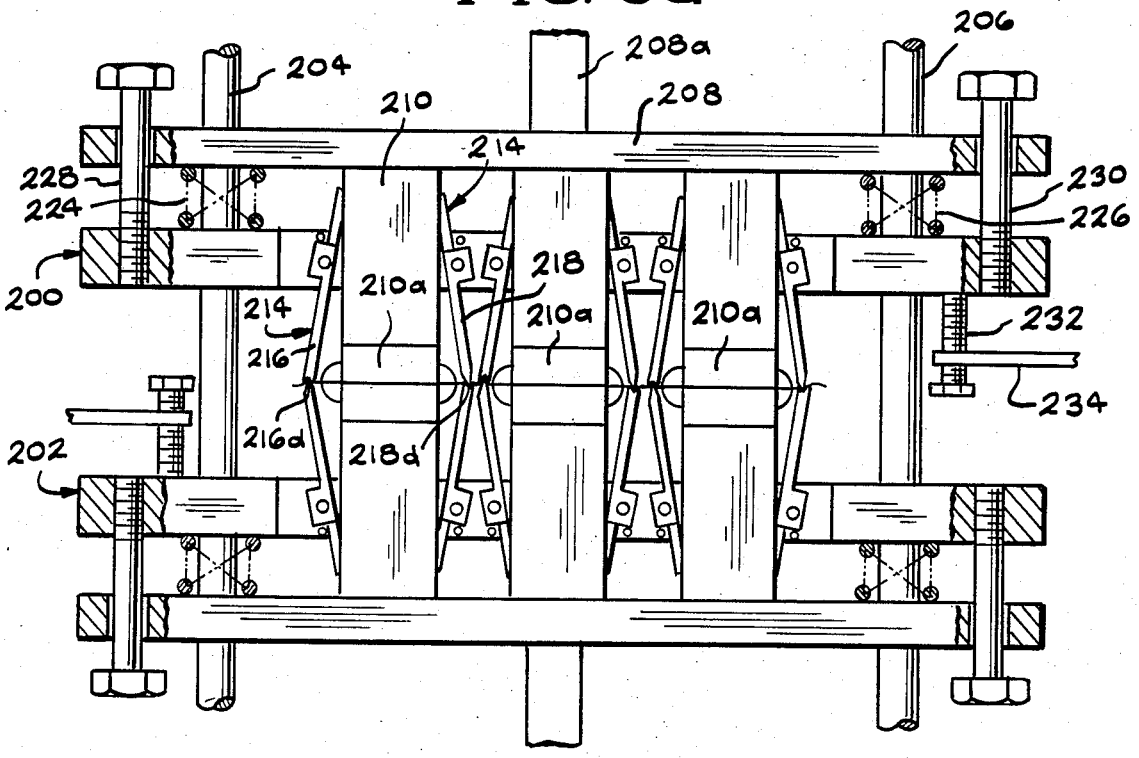

APPARATUS AND METHOD FOR PACKAGING A PRODUCT IN INDIVIDUAL PACKETS

CROSS-REFERENCE TO A RELATED APPLICATION

The present application is a continuation-in-part application of Ser. No. 450,275 filed Dec. 16, 1982, and now U.S. Pat. No. 4,545,180, and entitled "MACHINE FOR MAKING AND FILLING PACKETS AND A PACKET CONTAINING A FLOWABLE PRODUCT" and assigned to the assignee of the present invention, and which is herein incorporated by reference.

BACKGROUND OF THE INVENTION

The present invention relates in general to an apparatus and method for packaging a product and, in particular, to an apparatus and method for packaging a flowable product in individual packets constructed of a sheet of flexible packaging material.

Machines for making and filling packets containing flowable or pulverulent materials such as sugar or catsup, for example, are well known and have been used to a great degree of satisfaction. One such machine is disclosed in U.S. Pat. No. 3,404,506.

However, it is an ever increasing desire not only to improve the efficiency of such machines to the end that greater production is achieved, but also to produce a simpler and more reliable machine. Currently, the speed of production has been such that it has been difficult to realize an acceptable profit margin. Also, the capacity of the packets heretofore produced have been somewhat limited.

SUMMARY OF THE INVENTION

The present invention relates to a unique method and apparatus for packaging a product in a packet having an increased capacity as compared to prior art packets produced from a sheet of packaging material of similar size. The packets are formed from a flexible sheet material such as paper or plastic suitably coated so that sealing between two contacting sheet portions can be effected with, for example, heated pressure pads.

In particular, the method of the present invention includes forming a flexible sheet of packaging material into a generally U-shaped channel having spaced apart generally vertical sidewalls. The facing surfaces of the sidewalls are sealed at horizontally spaced apart locations to define a packet assembly consisting of a plurality of open top packets. During the sealing of the spaced apart vertical side seals, the portions of the sidewalls located between the side seals are maintained in spaced apart relationship. A predetermined amount of a flowable product such as sugar, for example, is then directed into each open top packet. Next, the upper corners of each packet are sealed to reduce the size of the opening of the packet. After the upper corners have been sealed, a predetermined portion of each sealed upper corner is cut away from the packet. This enables the upper corners of each individual packet to be pulled away from one another in a generally horizontal direction, thereby urging the upper marginal edges of the sidewalls of the packet toward one another. The upper marginal edges of the packets are then sealed together to close the packet.

The apparatus of the present invention includes an initial forming and side sealing station wherein a sheet of flexible packaging material is formed into a U-shaped channel and the sidewalls of the U-shaped channel are sealed at horizontally spaced apart locations to produce a partially formed packet assembly. The apparatus includes means for maintaining the intermediate portions of the sidewalls in spaced apart relationship during the side sealing operation. After the side sealing operation, a vacuum transfer unit transfers the partially formed packet assembly to a carriage which is utilized to transport the package assembly in a horizontal path to a product dispensing or filling station wherein the individual packets are filled with a product.

After the filling operation, the carriage transports the filled packets to a corner sealing station wherein the upper corners of the packets are sealed, and then to a corner cutting station wherein the upper corners of the packets are cut away from the packet. Finally, the packets are transported to a top stretching and sealing station wherein the upper corners of the packets are pulled away from one another and the upper marginal edges are sealed together to completely close the packets. From the top sealing station, the packets are transported to a separation and release station wherein the packets are separated from one another and then released from the carriage and directed into a suitable shipping container.

The method and apparatus for packaging a product according to the present invention offers several advantages over the prior art packaging machines. Since the intermediate sidewall portions of the packets are maintained in spaced apart relationship during the side sealing operation, the interior of the packet is capable of storing a greater quantity of product as compared to the storage capacity of a prior art packet constructed of a similar amount of packaging material. However, by maintaining the sidewalls in spaced apart relationship, the upper sealing operation of the packet is rendered more difficult due to the fact that the length of sheet material defining the upper marginal edges of the packet is greater than the overall width of the packet. Thus, conventional approaches to sealing the top marginal edges would result in overlapping, wrinkled portions and possibly an ineffective seal. The present invention solves this problem by providing a unique approach to sealing the upper end of the packet. By first sealing the upper corners of the packet and then cutting away portions of each upper corner, the upper corner portions of the packet can be pulled away from one another prior to the top sealing operation to reduce any overlapping or wrinkled portions. It has been discovered that such a procedure provides a very effective top seal.

The apparatus of the present invention also includes several other unique features. The apparatus includes a perforation means for forming spaced apart, generally parallel perforated lines in the sheet of packaging material prior to forming the U-shaped channel. The perforated lines divide the sheet into individual portions each of which are utilized to construct a single packet. The perforated lines enable the individual packets to be easily separated from one another.

Also, in the apparatus of the present invention, the filling station is separated from the sealing stations to reduce the possibility that a portion of the product would contaminate the sealing stations and thus interfere with the sealing operations of the machine.

BRIEF DESCRIPTION OF THE DRAWINGS

The above, as well as other advantages of the present invention, will become readily apparent to one skilled in the art from reading the Detailed Description of the Preferred Embodiment in conjunction with the attached drawings, in which:

FIGS. 2*a* through 2*g* are perspective views showing, in sequence, the various steps utilized to transform a sheet of packaging material into a plurality of individual sealed packets each containing a predetermined amount of a flowable product; in FIG. 2*a*, a rectangular sheet of flexible packaging material has been formed into a generally U-shaped channel; in FIG. 2*b*, the facing surfaces of the U-shaped channel have been sealed at selected spaced apart vertical locations to define a plurality of individual open top packets; in FIG. 2*c*, the upper corners of each of the individual packets have been sealed together to reduce the size of the opening of the respective packet; in FIG. 2*d*, a portion of the upper corners of each individual packet has been cut away; in FIG. 2*e*, the upper corners of each individual packet have been pulled away from one another to cause the spaced apart upper marginal edges of the respective packet to move toward one another; in FIG. 2*f*, the remaining unsealed top portion of the packet is sealed to close the packet; in FIG. 2*g*, a single completed packet is shown after being separated from the group shown in FIG. 2*f*.

in FIG. 3*a*, a predetermined length of flexible packaging material has been cut and is in position to be moved downwardly; in FIG. 3*b*, forming members are moved downwardly to form the flexible sheet of packaging material into a U-shaped channel as shown in FIG. 2*a*; in FIG. 3*c*, a pair of cooperating sealing members have been moved toward one another to seal selected horizontally spaced apart locations in the U-shaped channel member and define a packet assembly consisting of a plurality of individual open top packets as shown in FIG. 2*b*; in FIG. 3*d*, the forming members and the side sealing members have been retracted and the packet assembly is held by a vacuum holding unit; in FIG. 3*e*, the packet assembly, held by the vacuum unit, has been moved partially downwardly by a transfer assembly; in FIG. 3*f*, the vacuum transfer assembly has positioned the packet assembly within a carriage assembly;

in FIG. 6*a*, the filling mechanism is in the up position and the packets have been positioned by the carriage to receive the product; in FIG. 6*b*, the filling mechanism has been moved downwardly and the packets are maintained in an open position while they are filled;

in FIG. 7*a*, a pair of cooperating corner sealing members are spaced apart and the packet assembly has been positioned therebetween; in FIG. 7*b*, the corner sealing members are moved toward one another to contact the packet assembly and seal the upper corners of each packet as shown in FIG. 2*c*;

in FIG. 8*a*, a pair of cooperating cutting assemblies are in the open position and the packet assembly has been positioned therebetween; in FIG. 8*b*, the cutting assembly has been partially closed such that a plurality of spring biased holding pins are in position to securely hold the upper portions of the packets during the cutting operation; in FIG. 8*c*, the cutting assemblies have been closed and the upper corner sections of each individual packet have been cut away as shown in FIG. 2*d*;

FIGS. 9*a*, 9*c*, and 9*d* illustrate the sequence of operations performed by the top stretching and sealing station of FIG. 1 in producing the packet assemblies as illustrated in FIG. 2*e* and 2*f*; in FIG. 9*a*, a pair of cooperating top sealing mechanisms are in the open position and the packet assembly has been positioned therebetween; in FIG. 9*c*, the sealing mechanisms have been moved partially toward one another and a group of pulling fingers have engaged the corner sections of the individual packets to stretch the top of each packet as shown in FIG. 2*e*; in FIG. 9*d*, the sealing mechanisms have been moved further toward one another to seal the remaining unclosed portion of the packets as shown in FIG. 2*f*;

in FIG. 10*b*, the separation arms and the carriage opening arms are in the up position and the carriage assembly has positioned the perforated portions of the packet assembly in vertical alignment with the separation arms; in FIG. 10*c*, the separation arms have been moved downwardly to separate the packets from one another; in FIG. 10*d*, the separation arms have been retracted upwardly and the carriage opening arm has been moved downwardly to open the carriage jaws and release the packets.

DETAILED DESCRIPTION OF THE PREFERRED EMBODIMENT

The machine of the present invention produces sealed packets or pouches and fills them with a flowable material, such as, for example, sugar, mayonnaise, or catsup. The packets are formed of paper suitably coated so that sealing can be effected with heat. Also, cold pressure sensitive material can be employed. Other than paper, the sheet material may be plastic, foil, metal foil, or combinations thereof, depending upon the product to be packaged.

Figure 1:
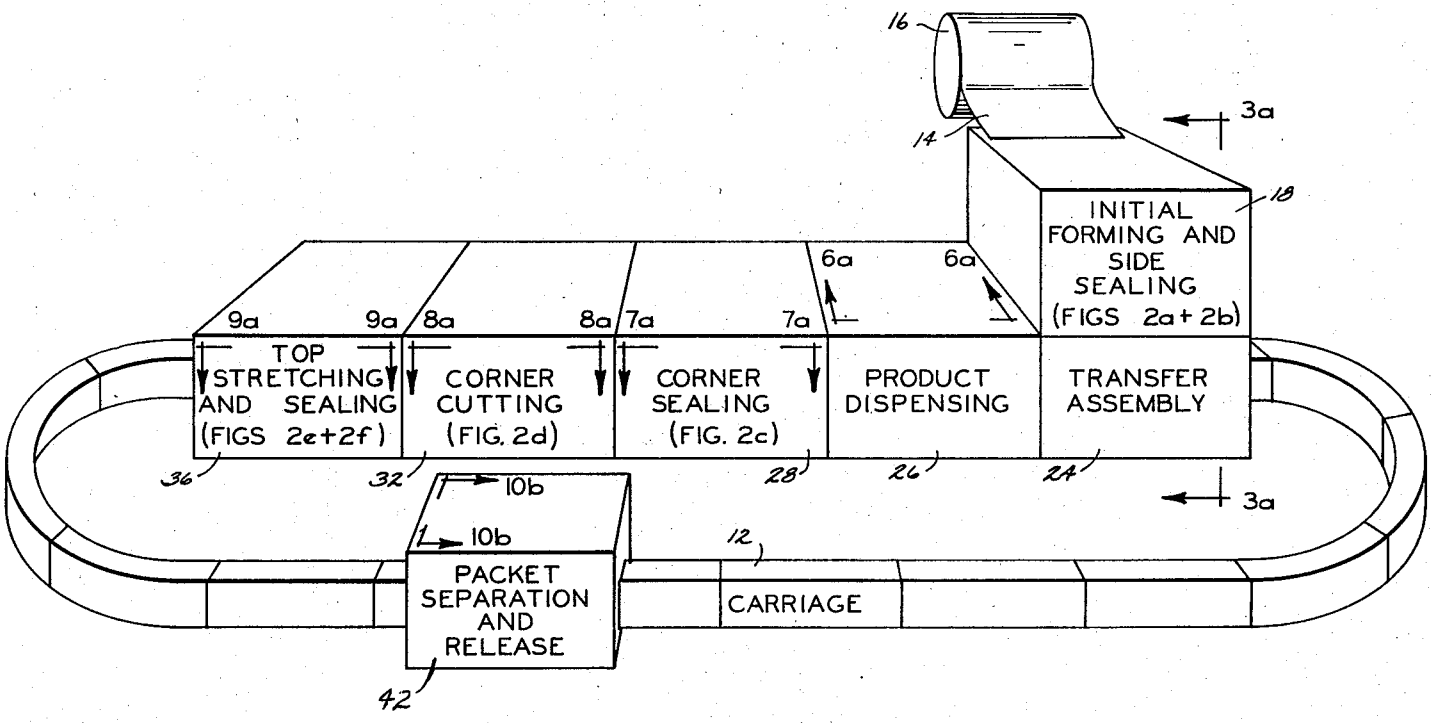
FIG. 1 is a block diagram illustrating the various stations which are included in the packaging apparatus of the present invention.

FIG. 1 is a block diagram which illustrates a package forming machine 10 according to the present invention. FIG. 1 will be utilized in conjunction with FIGS. 2*a* through 2*f* to generally describe the method by which the individual packets are formed. A more detailed explanation of the mechanisms and components utilized to perform the method will be discussed hereinafter.

Referring to FIG. 1, the packaging machine includes a plurality of individual stations which are adapted to perform selective operations in transforming a sheet of flexible packaging material into a plurality of individual filled packets. As will be discussed, the packets are transported from one station to another by means of a carriage assembly 12.

In FIG. 1, a flexible strip 14 of packaging material on a supply roll 16 is supplied to an initial forming and side sealing station 18. The initial forming station 18 is adapted to sever a predetermined length of the flexible strip 14 and to form the severed rectangular portion into a generally U-shaped channel 20 as shown in FIG. 2*a*. Prior to severing the strip 14, the station 18 forms perforated lines 20*a* in the strip 14, as shown in FIG. 2*a*, to define the lines along which the individual packets will subsequently be separated. In FIG. 2*a*, the U-shaped channel 20 includes spaced apart generally parallel sidewalls 20*b* and 20*c* and a lower U-shaped portion 20*d*.

After the U-shaped channel 20 of FIG. 2*a* is formed, selected portions of the spaced apart sidewalls 20*b* and 20*c* which define the side marginal edges of the individual packets are sealed in a manner as shown in FIG. 2*b* to define a packet assembly 21 comprising a plurality of individual spaced apart open top packets 22 having side seals 22*a* and 22*b*. As will be discussed, the portions of the spaced apart sidewalls 20*b* and 20*c* which are intermediate the side seals 22*a* and 22*b* are maintained in a spaced apart relationship during the sealing operation of FIG. 2*b* such that the packets have a bottom portion 22*c* spaced upwardly from the lower ends of the side seals 22*a* and 22*b*. By maintaining the sidewalls of the packet in spaced apart relationship during the initial sealing operation, more product is able to be packaged in a packet constructed of a given amount of packaging material.

After the individual packets 22 have been formed in a manner as shown in FIG. 2*b*, the packet assembly is transferred to the carriage 12 by means of a vacuum transfer assembly 24. The carriage 12 securely holds the packet assembly 21 and is coupled to a suitable drive mechanism (not shown) for transporting the packet assembly to the remaining forming stations. Initially, the carriage 12 transports the packet assembly 21 to a product dispensing station 26 at which point each of the individual packets 22 are filled with a predetermined amount of a product. After the packets have been filled, the packets are transported to a corner sealing station 28 wherein the upper corner portion of each individual packet 22 is sealed in areas 30*a* and 30*b*, as shown in FIG. 2*c*, to partially close the open top of the packets 22.

Next, the packets 22 are transported to a corner cutting station 32 wherein, as shown in FIG. 2*d*, the upper corner portions of each individual packet are cut away to define cutout portions 34*a* and 34*b*. As will be discussed, the cutouts 34*a* and 34*b* enable a more effective top seal to be achieved while also providing an inwardly extending slit in the side seal of the packet which assists a user in the opening of a sealed packet. After the upper corners are cut, the packet assembly is transported to a top stretching and sealing station 36. As shown in FIG. 2*e*, the initial operation performed by the station 36 consists of pulling the upper corner portions 38*a* and 38*b* away from one another, thereby stretching the top portion and causing the upper marginal edges of the packets, which are spaced apart as shown in FIG. 2*d*, to come toward one another, as shown in FIG. 2*e*. After the top portion has been stretched, the unsealed portion of the top can be completely sealed to close the packet, as shown in FIG. 2*f* as top seals 40.

Because the intermediate portions of the sidewalls of the packet are maintained in spaced apart relationship during the side sealing operation, the length of the upper marginal edges of the packet to be sealed to one another will be greater than the overall width of the packet. Thus, conventional approaches to sealing the top of the packet would result in undesirable wrinkled or overlapping portions across the top of the packet which could possibly produce an ineffective seal. By providing the cutout portions 34*a* and 34*b* and causing the upper corners of each packet to be pulled away from one another prior to forming the top seal 40, wrinkled or overlapping portions across the top seal 40 are minimized.

In addition to enabling the upper corners of the individual packets to be pulled away from one another prior to the final sealing step, the cutout portions 34*a* and 34*b* are designed to assist a user in the opening of a sealed packet. As shown in FIG. 2*d*, the cutout 34*a* includes a horizontal cutting line 36*a* which extends inwardly into the packet past a vertically inclined cutting line 36*b* to form an inwardly extending slit 36*c*. It has been found that such a slit greatly assists a user in opening the individual packets. For example, the packet can be easily opened by the user by grasping the upper corner of a packet between the thumb and forefinger of one hand and grasping the respective side seal between the thumb and forefinger of the opposite hand and ripping the top portion away from the remaining portion of the packet.

After the packets have been completely sealed, the carriage 12 transports the packet assembly to a packet separation and release station 42 wherein the individual packets are first separated from one another along perforated lines 20*a* and then released from the carriage 12. As the separated packets are released from the carriage 12, they can be directed into a suitable shipping container (not shown). An individual completed completely sealed packet 44 is shown in FIG. 2*g*.

The individual stations which are schematically represented in FIG. 1 will now be discussed in more detail. It should be noted that the drive mechanisms utilized to operate the components of the individual stations are synchronized with one another such that when one station is performing an operation on a selected group of packets, the other stations are performing selected operations on other groups of packets. It will be appreciated that, after a thorough review of the components and the operations performed by each individual station, the manner in which the individual stations can be synchronized with one another through appropriate drive mechanisms and linkages is obvious to one of ordinary skill in the art.

Referring to FIGS. 3*a* through 3*f* and FIGS. 4*a* through 4*c*, there is shown the initial packet forming and side sealing station 18 and the vacuum transfer assembly 24. The sheet material 14 from the supply spool 16 is directed by a series of rollers 50*a* through 50*d* onto the upper surface of a cutting platform 52. A shaft 54 having a plurality of spaced apart circular cutting blades 54*a* maintained thereon (shown in FIG. 4*e*) is adapted to form the individual perforated cuts 20*a* (shown in FIG. 2*a*) in the sheet material 14. Typically, the supply roll 16 and the shaft 54 are driven at the same speed and the roller 50*d* is driven at a slightly faster speed, while the rollers 50*a*, 50*b*, and 50*c* function as idlers.

Figure 3A:
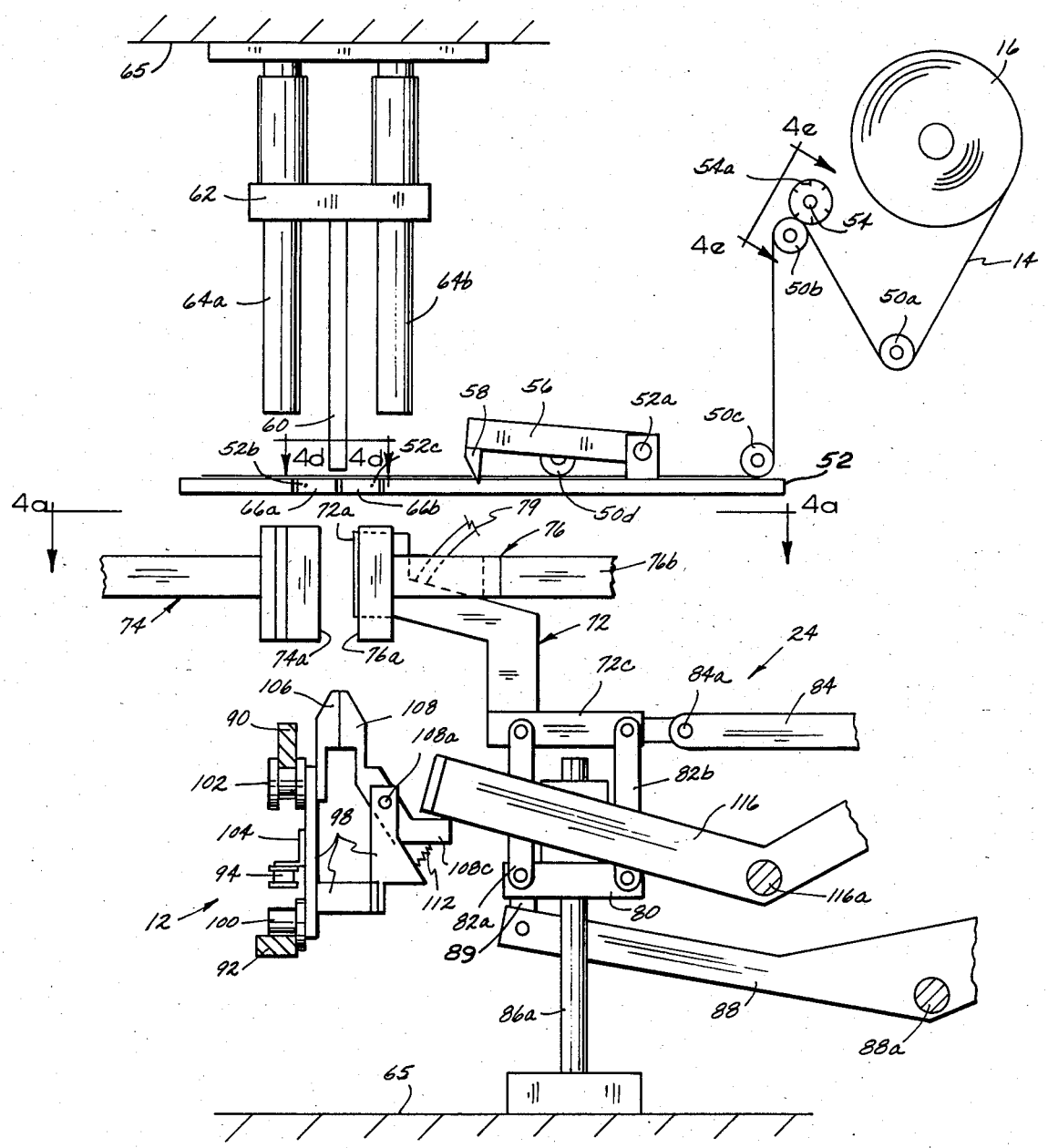
FIGS. 3*a* through 3*f* are sectional views which illustrate, in sequence, the operations of the initial packet forming and side sealing stations of FIG. 1 utilized in producing the packet assembly as shown in FIG. 2*b*.

A cutting arm 56 has one end pivotally mounted relative to the cutting platform 52 at 52*a* and has a cutting blade 58 mounted on the opposite end thereof. The cutting arm 56 is coupled to a suitable drive mechanism (not shown) which is synchronized with the main drive of the machine for controlling the movement of the cutting arm 56. When a predetermined length of the sheet 14 has been fed past the cutting blade 58, the cutting arm 56 is moved downwardly as shown in FIG. 3*a* to sever a predetermined length of the sheet 14.

Figure 4A:
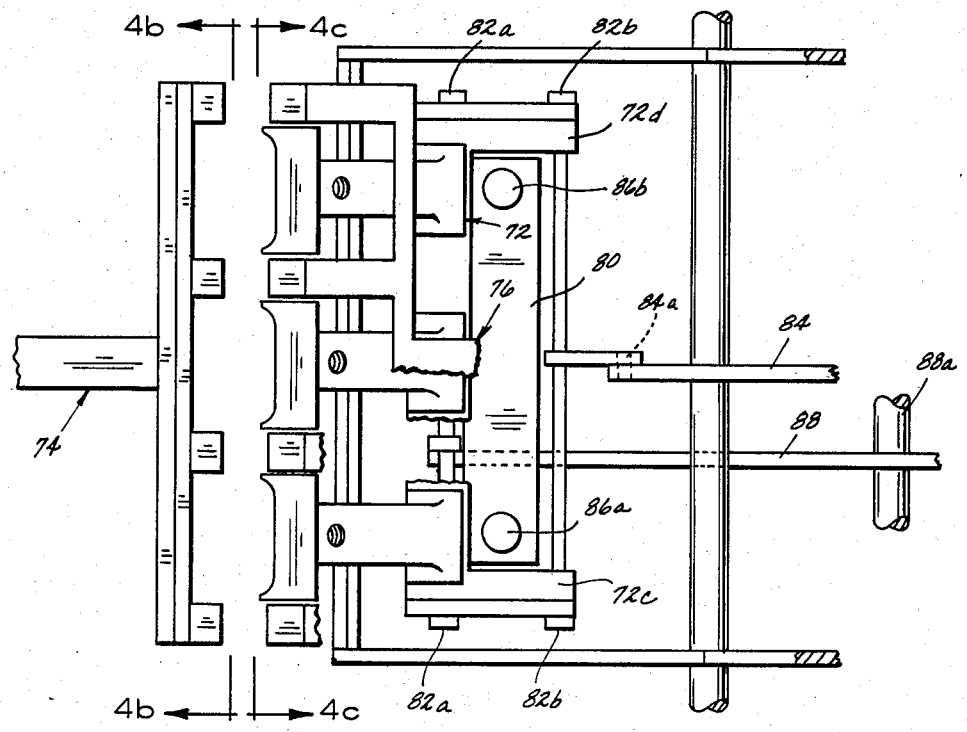
FIG. 4*a* is a sectional view taken along the line 4*a*—4*a* in FIG. 3*a* and illustrating a top view of the side sealing members and the vacuum transfer assembly.
Figure 4B:
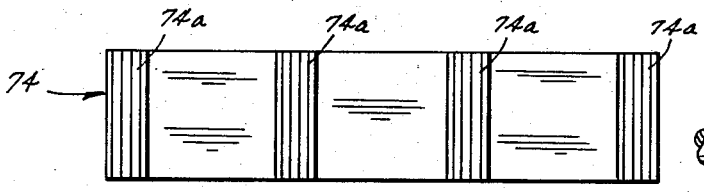
FIG. 4*b* is a sectional view taken along the line 4*b*—4*b* in FIG. 4*a* and illustrating the surface of one of the side sealing members which faces the packet assembly.
Figure 4E:
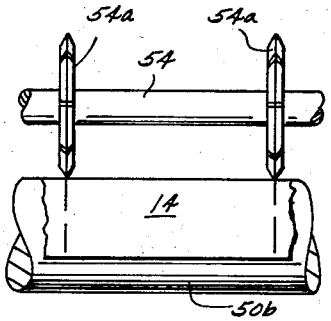
FIG. 4*e* is a sectional view taken along the line 4*e*—4*e* of FIG. 3*a* and illustrating the spaced apart circular cutters utilized to form the perforated lines in the sheet of packaging material.
Figure 4C:
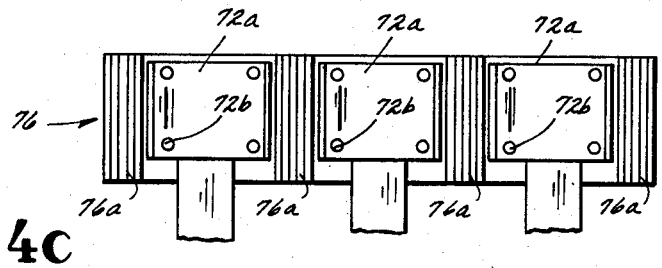
FIG. 4*c* is a sectional view taken along the line 4*c*—4*c* in FIG. 4*a* and illustrating the surface of the vacuum holding unit which faces the packet assembly.
Figure 4D:
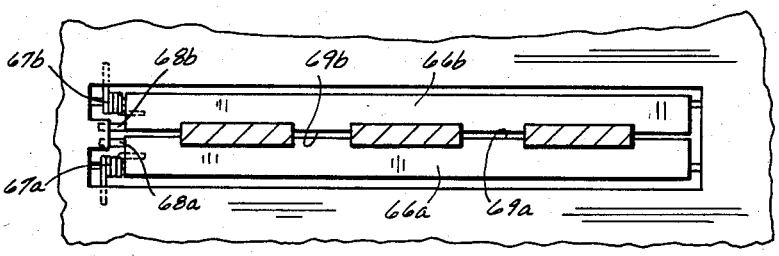
FIG. 4*d* is a sectional view taken along the line 4*d*—4*d* of FIG. 3*a* and illustrating the cross-sectional configuration of the vertical forming members.

A plurality of downwardly extending forming members 60 (having a cross-section as illustrated in FIG. 4*d*) are mounted on a support 62 slidably mounted on a pair of spaced apart vertical guide shafts 64*a* and 64*b*. The guide shafts 64*a* and 64*b* are secured relative to the main frame 65 of the machine. As shown in FIGS. 3*a* and 4*d*, a pair of elongate forming flaps 66*a* and 66*b* are located immediately below the forming members 60 and are pivotally attached to the cutting platform 52 at 52*b* and 52*c* respectively. The flaps are biased upwardly by springs 67*a* and 67*b* and are maintained in a normally horizontal position by means of stop members 68*a* and 68*b* respectively. The extreme outer ends 69*a* and 69*b* of the flaps 66*a* and 66*b* respectively define an elongate aperture through which the sheet is forced.

Figure 3B:
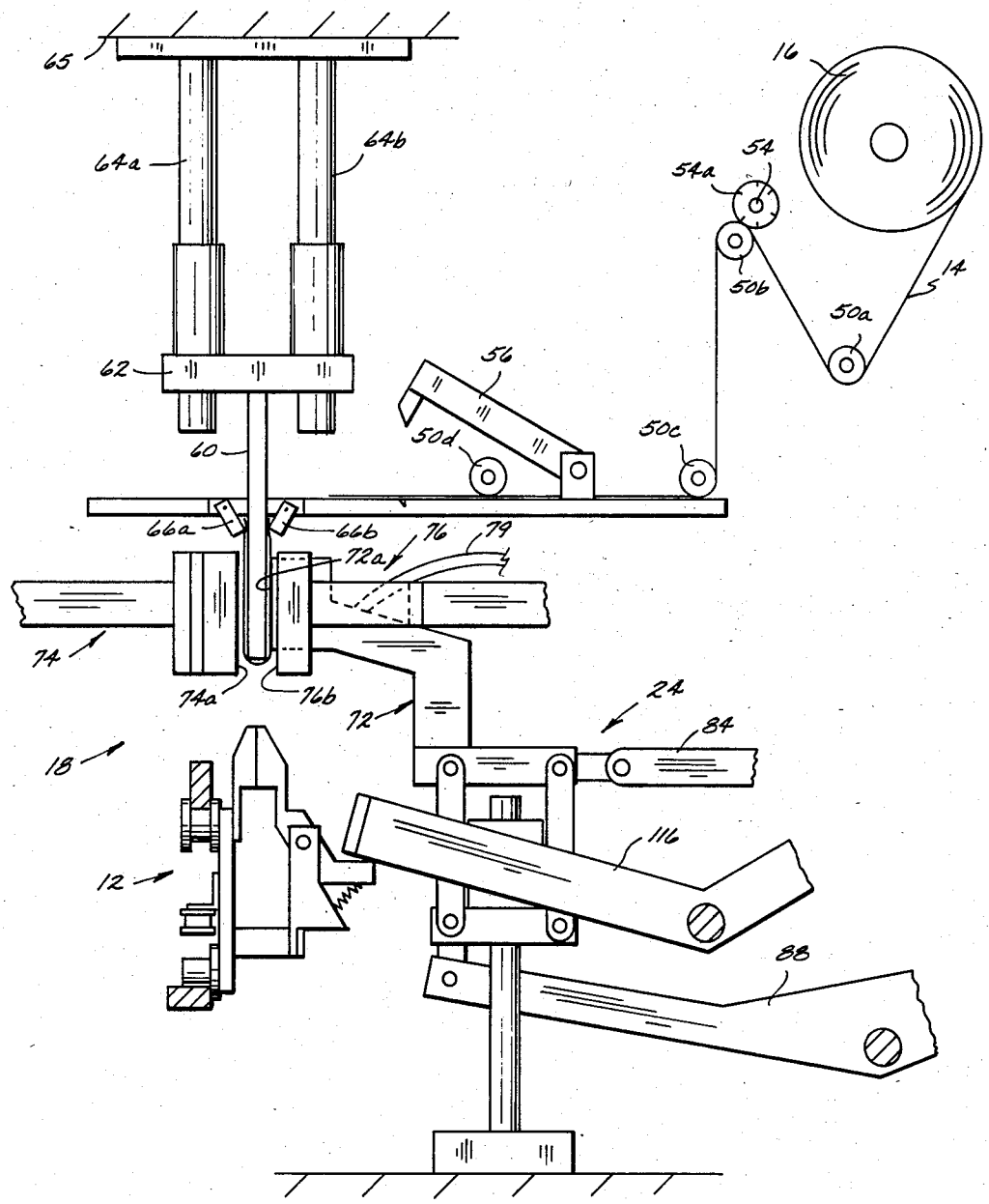

Once the sheet has been cut by the cutting blade 58, the support 62, which is connected to a suitable synchronized drive mechanism (not shown), causes the members 62 to move downwardly, as shown in FIG. 3*b*, such that the forming flaps 66*a* and 66*b* are pivoted downwardly and the severed portion of the sheet 14 is forced between the flaps 66*a* and 66*b* to form a U-shaped channel as shown in FIG. 2*a*. The forming members are moved downwardly such that the U-shaped channel is frictionally held by the forming flaps 66*a* and 66*b* and is positioned between a pair of spaced apart side sealing members 74 and 76.

Figure 3C:
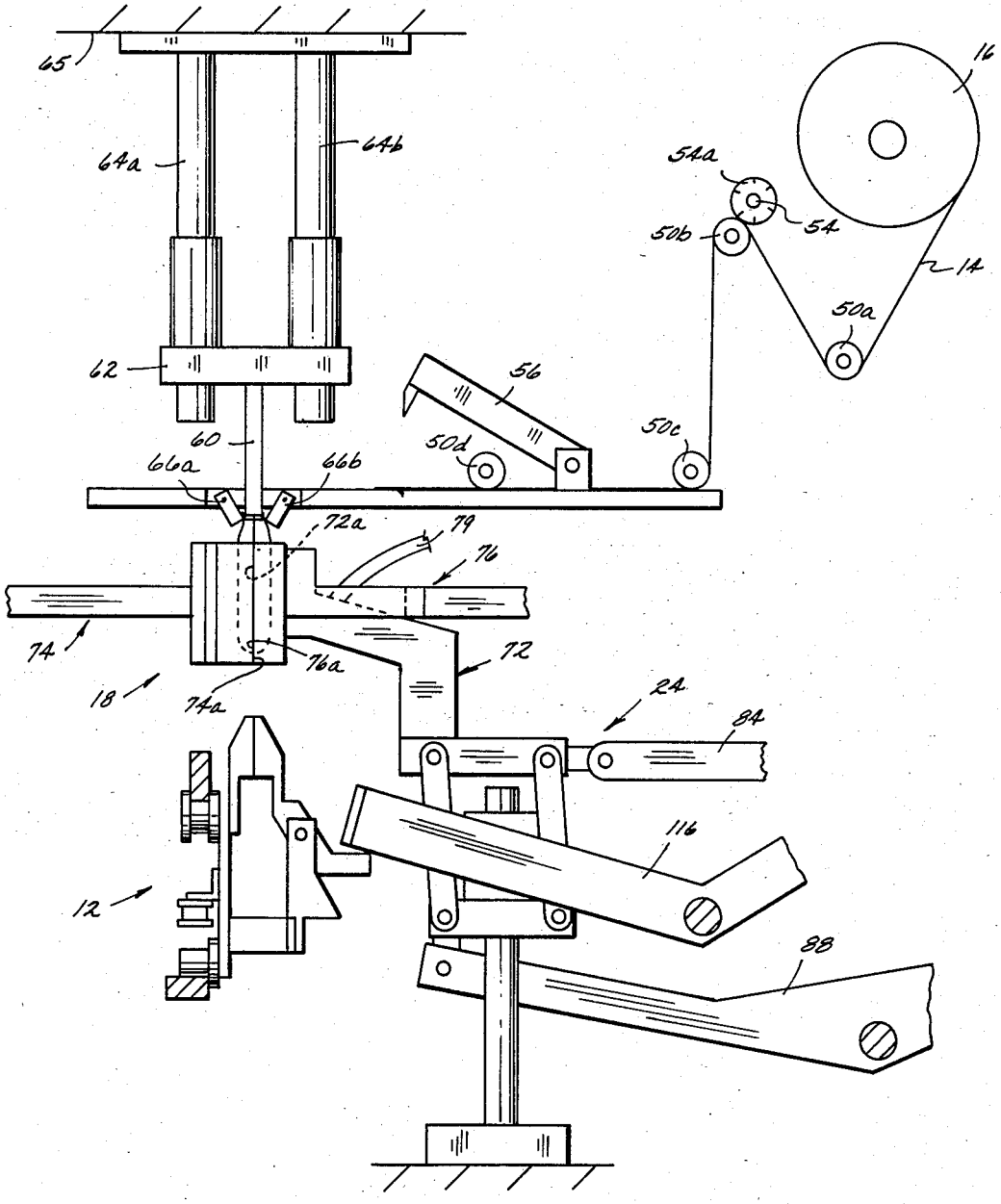

As shown in FIGS. 4*a*, 4*b*, and 4*c*, the side sealing members 74 and 76 have spaced apart heated sealing pads 74*a* and 76*a* respectively for engagement with selected portions of the U-shaped channel to cause selected facing portions of the sidewalls to be pressed into engagement with one another. The side sealing members 74 and 76 include arms 74*b* and 76*b* respectively which are connected to a suitable synchronized drive mechanism (not shown) for moving the sealing members 74 and 76 toward and away from one another. After the forming members have been moved downwardly as shown in FIG. 3*b* to form the U-shaped channel, the side sealing members are moved toward one another, as shown in FIG. 3*c*, to cause selected portions of the facing surfaces of the U-shaped channel to seal to one another in a manner shown in FIG. 2*b*. During the side sealing operation, the vertical forming members remain in the down position to maintain the intermediate portions of the sidewalls of the packets in a spaced apart relationship.

As previously mentioned, the vacuum transfer assembly 24 is utilized for transferring the packet assembly having the side seals formed therein from the initial forming and side sealing station 18 to the carriage 12 which transports the packet assembly to the other forming stations. As shown in FIGS. 3*a*, 4*a*, and 4*c*, the vacuum transfer assembly 24 includes a vacuum head unit 72 having a plurality of individual vacuum heads 72*a* utilized for supporting a packet assembly as it is transferred to the carriage 12. The individual vacuum heads 72*a* have apertures 72*b* formed therein which are connected by lines 79 to a source of vacuum (not shown). The vacuum head unit 72 includes a pair of spaced apart lower arms 72*c* and 72*d* connected to a vertically slidably mounting member 80 by means of two spaced apart pairs of linkage arms 82*a* and 82*b*. The horizontal position of the vacuum head unit 72 is controlled by means of a horizontal control arm 84 pivotally connected to the vacuum head unit at 84*a*. The mounting member 80 is slidably mounted on a pair of vertical guide shafts 86*a* and 86*b* which are secured relative to the main frame 65 of the machine. The vertical position of the vacuum head unit 72 is controlled by means of a vertical control arm 88 pivoted about point 88*a* and pivotally connected to the mounting member 80 by means of a connecting link 89.

Figure 3D:
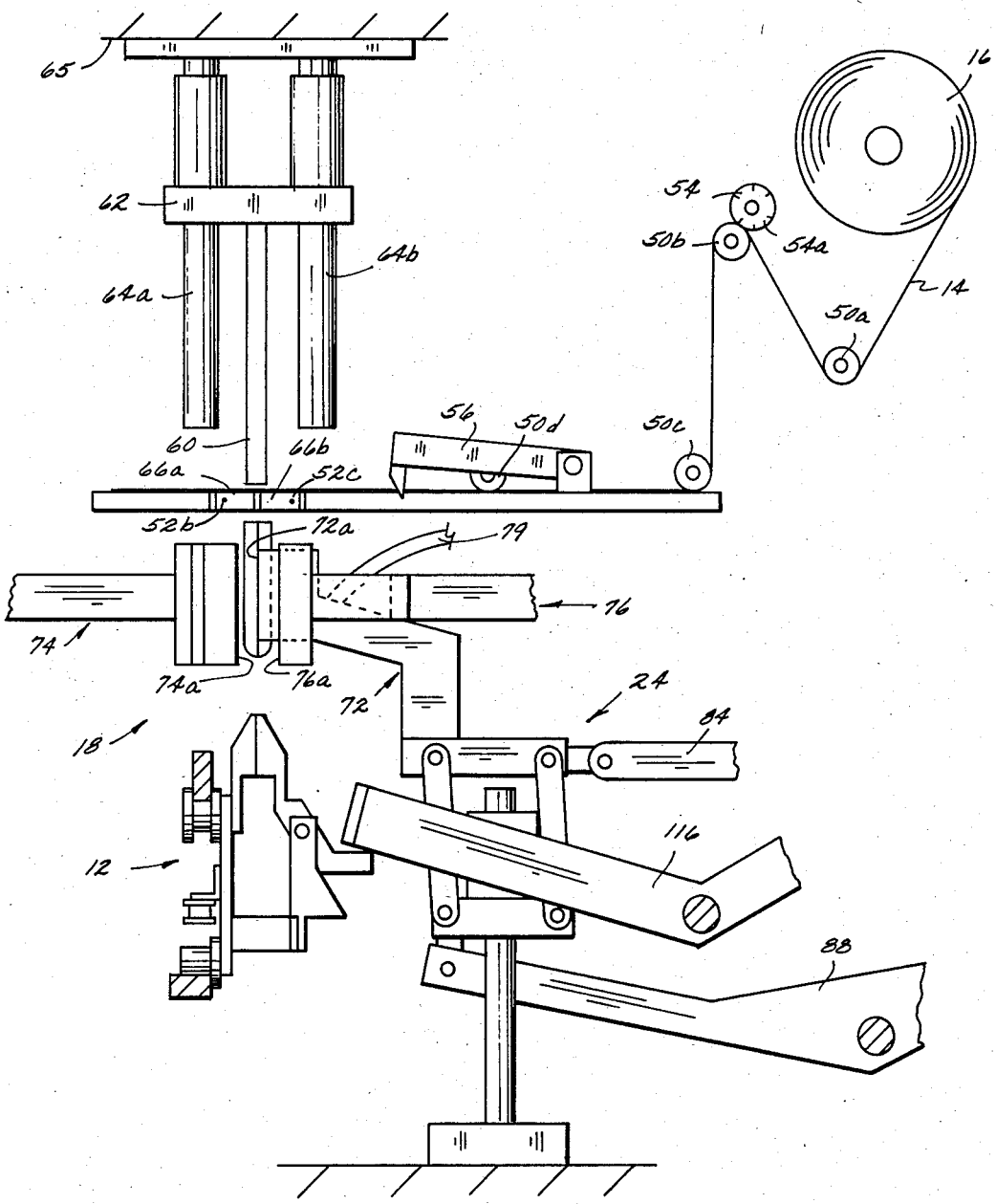
Figure 3E:
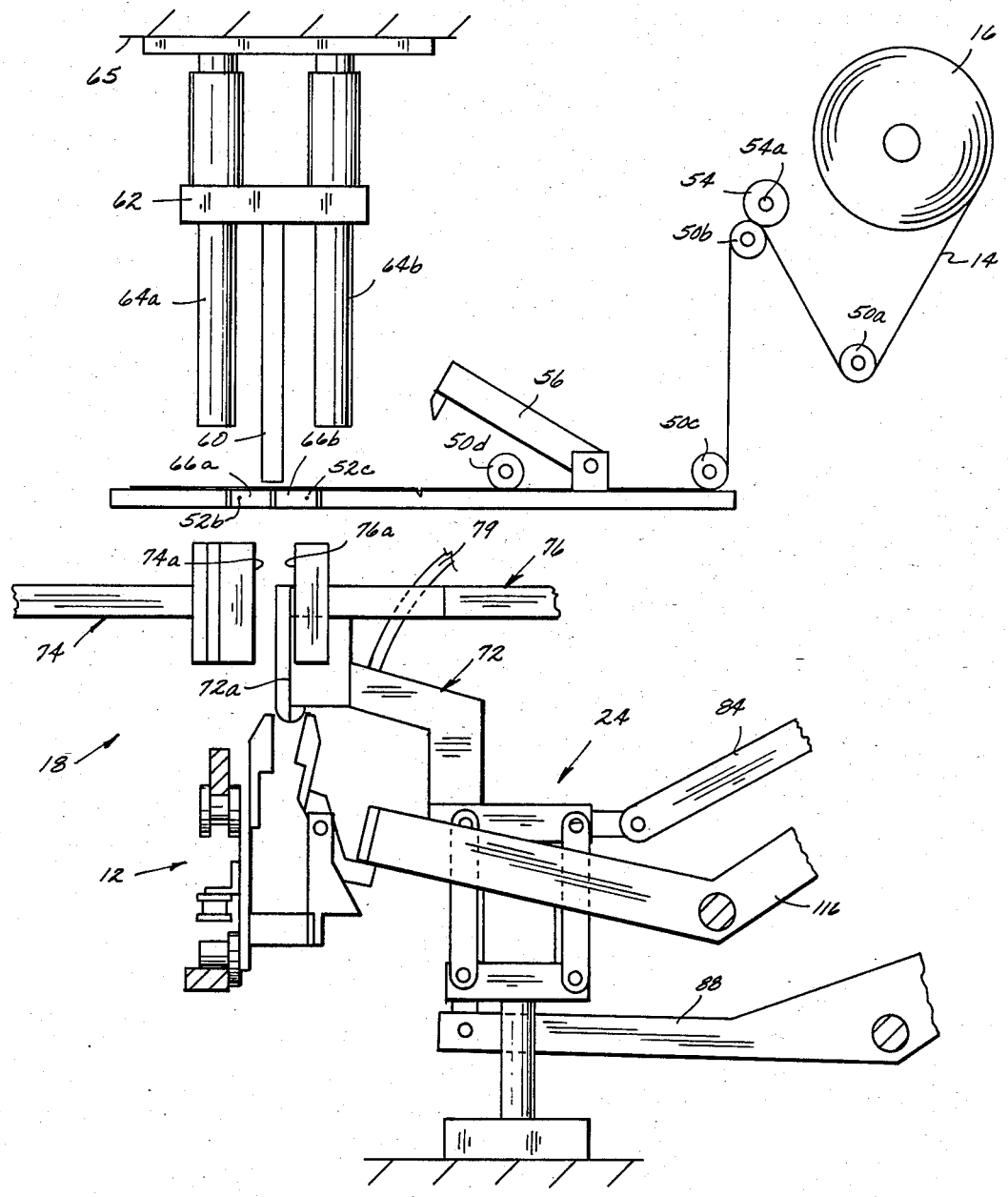

After the side sealing members 74 and 76 have been moved toward one another to effect the side sealing operation as shown in FIG. 3*c*, the vacuum head unit 72 is moved inwardly adjacent the packet assembly and vacuum is applied to the vacuum heads 72*a* to pull the packet assembly against the vacuum heads. When the vertical forming members 60 and side sealing members 74 and 76 have been retracted, as shown in FIG. 3*d*, the packet assembly will be supported entirely by the vacuum head unit 72. The control arms 84 and 88 are then operated to move the vacuum heads and the packet assembly downwardly, as shown in FIG. 3*e*, toward the carriage 12.

Figure 5:
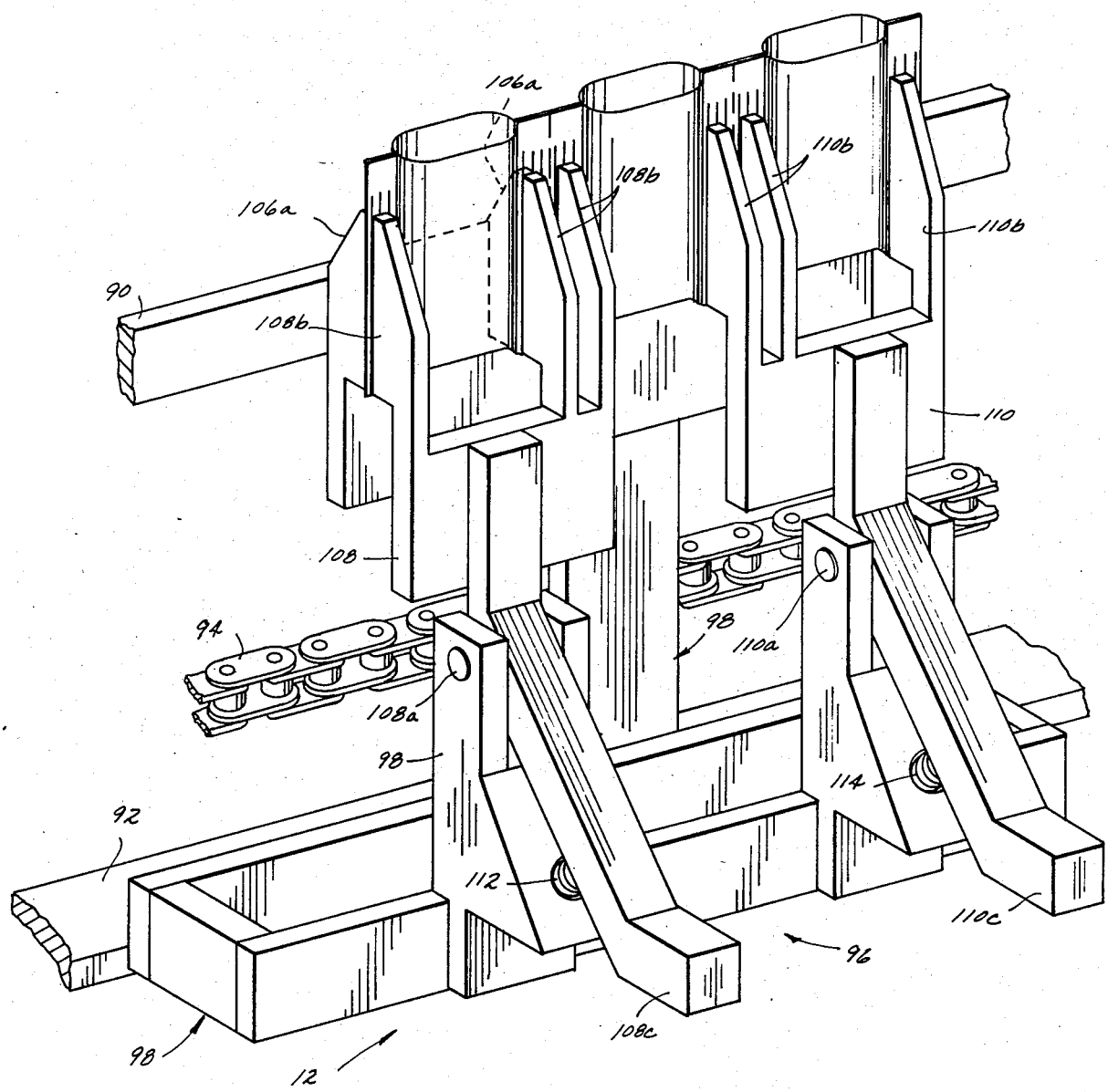
FIG. 5 is a perspective view of the carriage assembly utilized to transport a packet assembly from one station to another.

The carriage 12 utilized to transport the packet assemblies from station to station is shown in FIGS. 3*a* and 5. Basically, the direction of travel of the carriage 12 is controlled by a pair of guide rails 90 and 92, while the carriage is driven by a chain 94. The carriage 12 includes a plurality of individual holding units 96 of the type illustrated in FIG. 5, each of which is adapted to hold a separate packet assembly. In instances wherein the length of a packet assembly is greater than the holding capacity of a single holding unit, a plurality of adjacent holding units can be used to support a single packet assembly.

As shown in FIG. 3*a*, each individual holding unit 96 includes a main body 98 having a lower roller 100 which engages the lower guide rail 92 and an upper roller 102 which engages the upper guide rail 90. The main body is secured to the chain 94 by a bracket 104.

As shown in FIG. 5, the holding unit 96 includes an upper clamping assembly utilized for releasably supporting the packet assembly. The clamping assembly includes a fixed jaw member 106 secured to the main body 98 and having a plurality of spaced apart vertical clamping fingers 106*a*. A pair of jaw members 108 and 110 are pivotally mounted to the main body 98 at 108*a* and 110*a* respectively. The jaw members 108 and 100 include clamping fingers 108*b* and 110*b* which engage clamping fingers 106*a* of the fixed jaw member 106. As shown in FIG. 5, the clamping fingers are adapted to engage the packet assembly at locations which constitute the side seals of the individual packets.

The pivotally mounted jaw members 108 and 110 include lower release arms 108*c* and 110*c* for pivoting the jaw members about the pivot points 108*a* and 110*a*. A pair of springs 112 and 114 are connected between the jaw members 108 and 110 respectively and the main body 98 and are utilized to bias the jaw members into a clamping position.

Figure 3F:
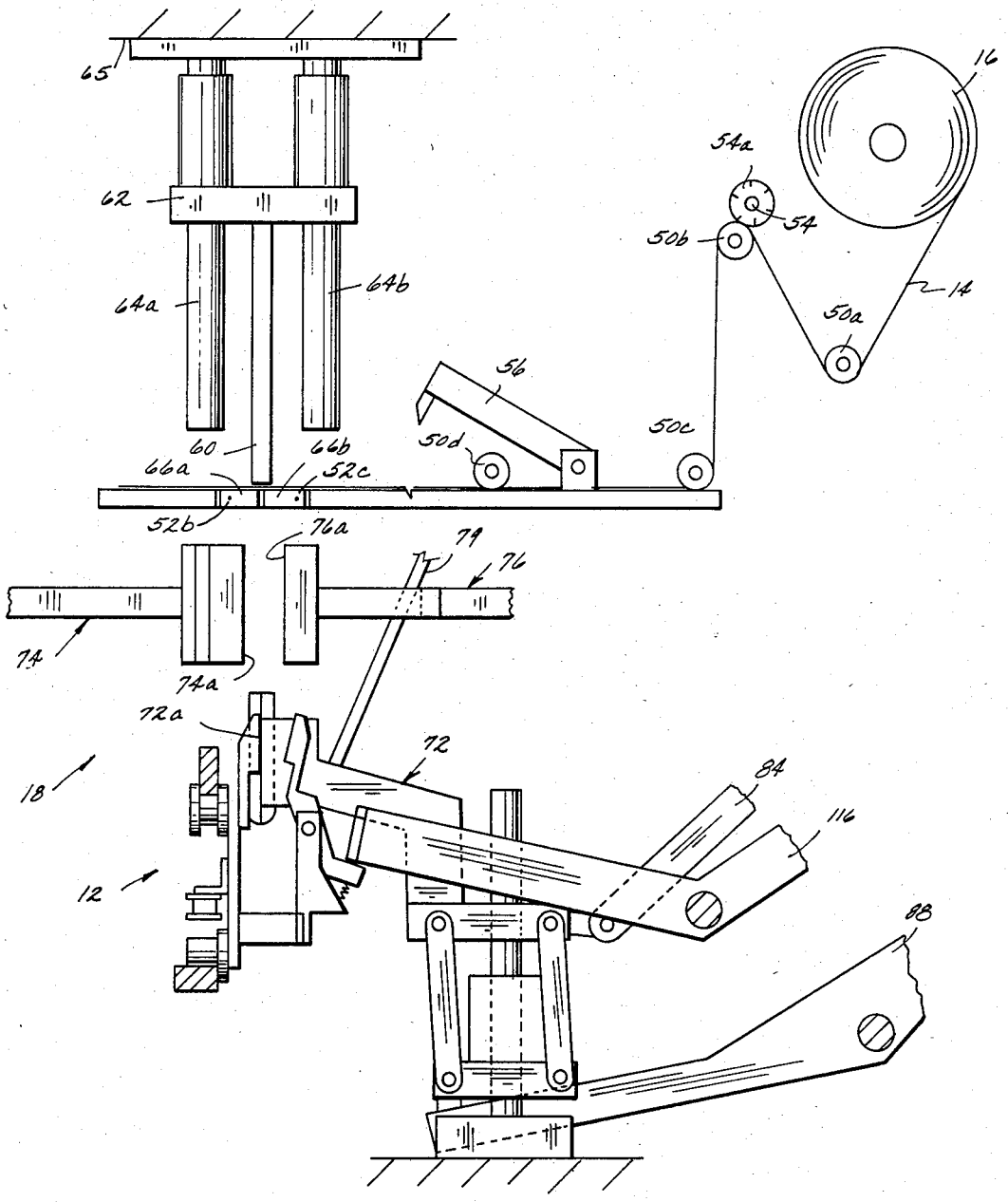

Once the side sealing members 76 and 78 have been retracted such that the packet assembly is held solely by the vacuum head unit 72, the vacuum head unit 72 can transfer the packet assembly to the carriage 12. As shown in FIG. 3*e*, as the packet assembly begins to move downwardly to the carriage 12, a release lever 116 connected to a suitable drive mechanism pivotally mounted at 116*a* relative to the main frame of the machine engages the release arms 108*c* and 110*c* and pivots the jaw members 108 and 110 to cause the clamping assembly to open. Next, the horizontal control arm 84 and the vertical control arm 88 are manipulated to move the vacuum head unit 72 to position the packet assembly as shown in FIG. 3*f*, at which time the release lever 116 can be pivoted to allow the clamping jaws to securely engage the packet assembly. The vacuum head unit 72 can then return to its upper position as shown in FIG. 3*a*. Once the packet assembly has been positioned within the carriage 12, the carriage can be driven to move the packet assembly to the product dispensing station 26.

Figure 6A:
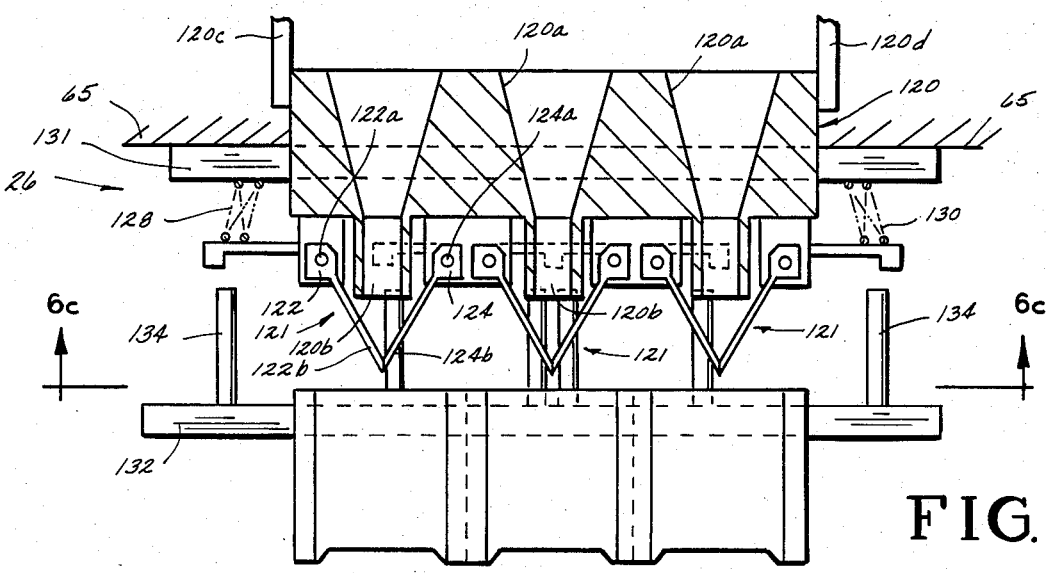
FIGS. 6*a* and 6*b* illustrate the sequence of operations of the product dispensing station of FIG. 1 in filling the individual packets with a product.
Figure 6B:
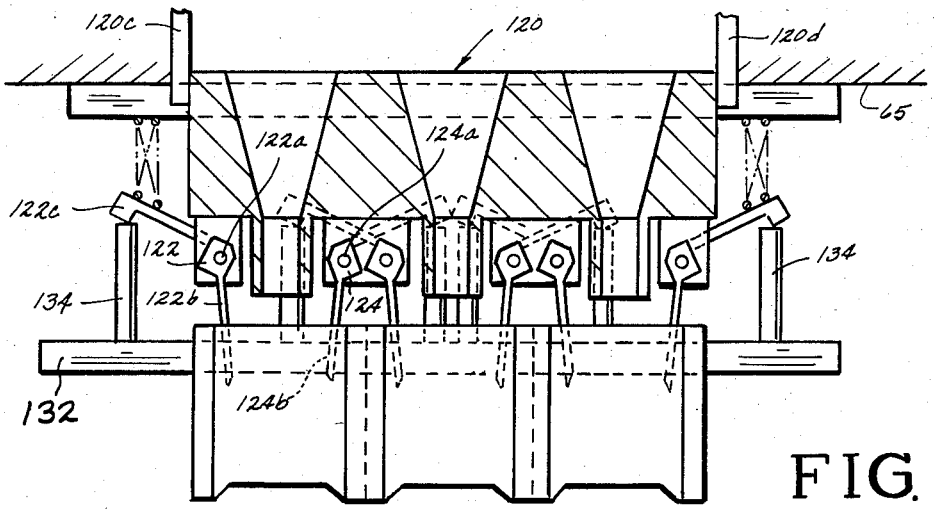
Figure 6C:
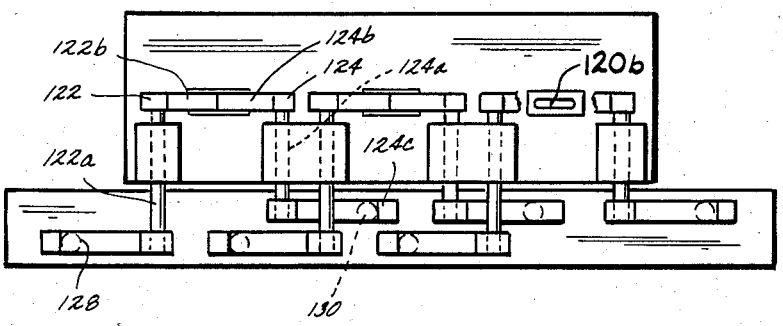
FIG. 6*c* is a sectional view taken along the line 6*c*—6*c* in FIG. 6*a* and illustrating a bottom view of the filling mechanism.

The product dispensing station 26 is shown in more detail in FIG. 6*a* through 6*c*. The product dispensing station 26 includes a funnel unit 120 having a plurality of individual funnels 120*a* each of which is adapted to receive a metered amount of a flowable product from a conventional metering apparatus (not shown) positioned above the funnel unit 120. When the packet assembly is suitably positioned below the funnel 120, the metering apparatus is actuated to dispense a predetermined amount of a product into each of the funnels. Each of the funnels 120*a* include a lower outlet 120*b* which, as will be discussed, directs the product into a packet positioned immediately below the outlet. The funnel unit 120 includes arm members 120*c* and 120*d* which are connected to a suitable drive mechanism (not shown) for controlling the vertical position of the funnel unit.

The product dispensing station 26 includes a plurality of opening mechanisms 121 which are utilized to ensure that each of the packets are fully opened when the product is dispensed. Each opening mechanism 121 includes a pair of opening elements 122 and 124 having shafts 122*a* and 124*a* pivotally mounted to the lower end of the funnel unit 120 on opposite sides of the associated funnel outlet 120*b* as shown in FIG. 6*c*.

The opening elements 122 and 124 include a downwardly extending opening arms 122*b* and 124*b* mounted on one end of the shafts 122*a* and 124*a* respectively which, when the opening mechanism 121 is in the up position as shown in FIG. 6*a*, have lower ends adapted to contact one another. The opening elements 122 and 124 include biasing arms 122*c* and 124*c* mounted on the opposite ends of the shafts 122*a* and 124*a* respectively which extend in a generally horizontal direction and are coupled to the lower ends of springs 128 and 130 having their upper ends coupled to a horizontal plate 131 fixed relative to the main frame of the machine.

Positioned below the channel member is another horizontal plate 132 fixed relative to the main frame of the machine and having a separate upstanding post member 134 positioned immediately below the outermost end of the biasing arm of each opening element. When the carriage 12 has positioned the packet assembly below the funnel unit 120 as shown in FIG. 6*a*, the funnel unit 120 and opening mechanism 121 are moved downwardly by the arm members 120*c* and 120*d*. As the outer ends of the biasing arms 122*c* and 124*c* of the opening elements 122 and 124 contact the upper ends of the actuating posts 134, the opening elements are pivoted about their respective pivot shafts, causing the opening arms to move away from one another. As the opening arms move away from one another, they are inserted into the openings at the top of the packets, as shown in FIG. 6*b*, to ensure that the packet is sufficiently opened to permit the dispensed product to be discharged into the packet. After the product has been dispensed, the carriage 12 is driven to transport the packet assembly from the product dispensing station 26 to the corner sealing station 28.

Figure 7A:
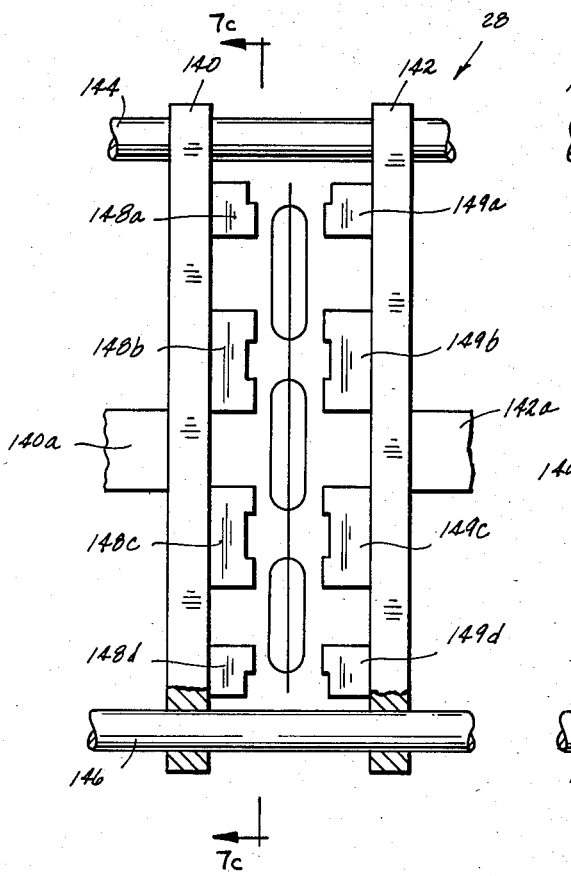
FIGS. 7*a* and 7*b* illustrate the operation of the corner sealing station of FIG. 1 utilized to produce the packet assembly as shown in FIG. 2*c*.
Figure 7B:
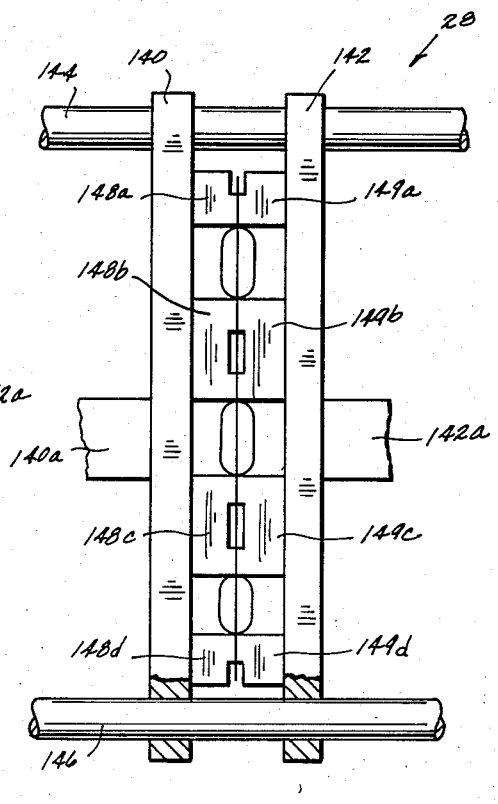
Figure 7C:
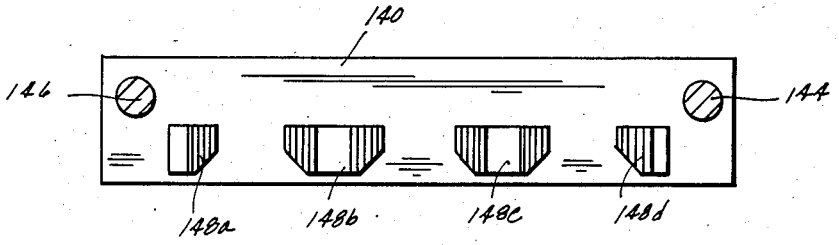
FIG. 7*c* is a sectional view taken along the line 7*c*—7*c* of FIG. 7*a* and illustrating the surface of one of the corner sealing members which the faces the packet assembly.

The components of the corner sealing station 28 are shown in more detail in FIGS. 7*a* through 7*c*. As shown in FIG. 7*a*, the corner sealing operation is performed by utilizing a pair of spaced apart support plates 140 and 142 slidably mounted on a pair of spaced apart horizontal guide shafts 144 and 146. The support plates 140 and 142 are coupled to a suitable drive mechanism (not shown) of the machine by arms 140*a* and 142*a*. As shown in FIG. 7*c*, a plurality of heated sealing pressure pads 148*a* through 148*d* are mounted on the face of the support plate 140 and cooperate with similar heated pads 149*a* through 149*d* on the opposite support plate 142 for effecting the desired corner sealing of the packets as shown in FIG. 2*c*. Once the packet assembly has been positioned by the carriage 12 between the plates 140 and 142 as shown in FIG. 7*a*, the sealing elements can be moved toward one another, as shown in FIG. 7*b*, to effect the desired corner sealing.

Figure 8A:
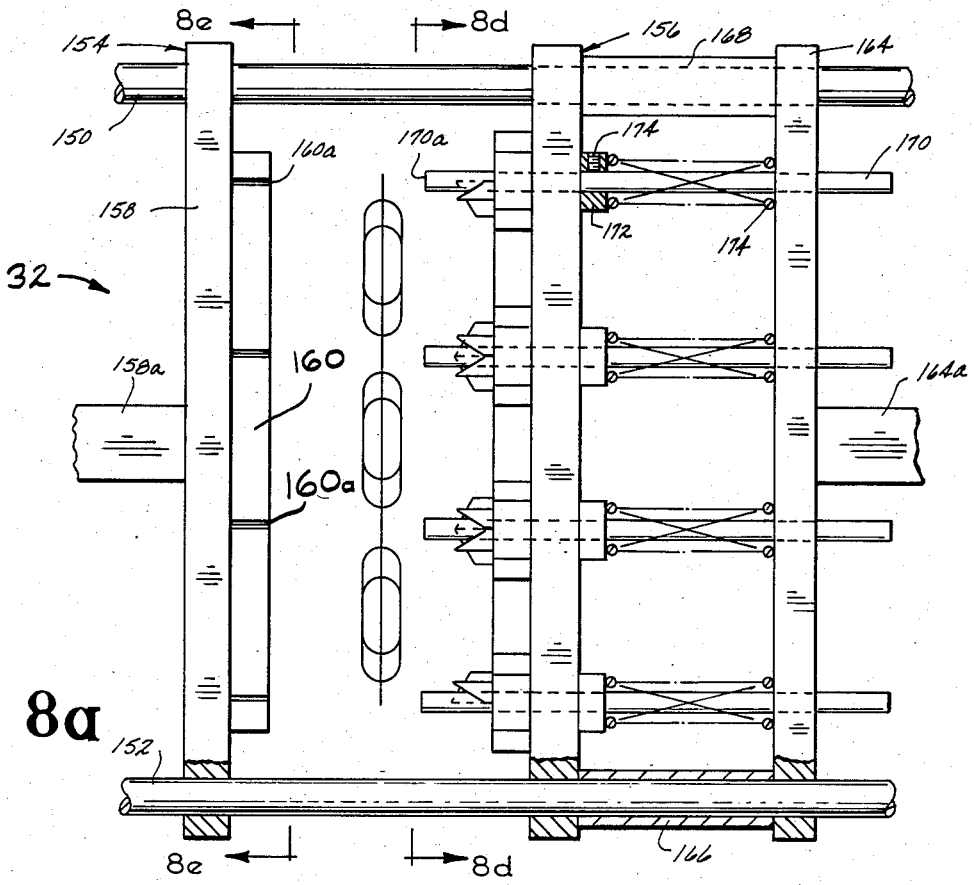
FIGS. 8*a*, 8*b*, and 8*c* illustrate the operations of the corner cutting station of FIG. 1 in producing the packet assembly as shown in FIG. 2*d*.

After the upper corners of each individual packet have been sealed, the packet assembly can be transferred to the corner cutting station 32 wherein the cutout portions shown in FIG. 2*d* are formed. The components of the corner cutting station 32 are shown in more detail in FIGS. 8*a* through 8*f*. As shown in FIG. 8*a*, the cutting assembly includes a pair of spaced apart horizontal guide shafts 150 and 152 for slidably supporting a first cutting mechanism 154 and a second cooperating mechanism 156 for movement toward and away from a packet assembly positioned therebetween. The first mechanism 154 includes a mounting plate 158 having apertures formed in the ends thereof for slidably receiving the guide shafts 150 and 152. One side of the mounting plate 158 is secured to an arm member 158*a* adapted to be connected to a suitable drive mechanism (not shown) for controlling the position of the first mechanism along the guide shafts 150 and 152. The opposite side of the mounting plate 158 is provided with a cutting block 160 having a plurality of grooves 160*a* (shown in FIG. 8*e*) formed therein which, as will be discussed, are utilized to receive portions of the cutting blades of the second mechanism when the two mechanisms are moved toward one another.

The second mechanism 156 includes a pair of spaced apart mounting plates 162 and 164 which are secured together by means of a pair of spaced apart sleeve members 166 and 168. The mounting plate 164 is secured to an arm 164*a* adapted to be connected to a drive mechanism (not shown) for controlling the position of the second mechanism along the guide shafts. A plurality of spaced apart holding pins 170 extend through apertures formed in the plates 162 and 164 and have outer end portions 170*a* which, as will be discussed, are utilized to securely hold the upper portions of the packets against the cutting block 160 of the first mechanism 154 during the cutting operation. A separate spring retaining ring 172 is adjustably secured by set screws 173 to each holding pin at a predetermined distance from the one end 170*a*. A separate helical compression spring 174 is mounted about the holding pin and has one end which engages the spring retaining ring 172 and an opposite end which engages a surface of the plate 164.

Figure 8F:
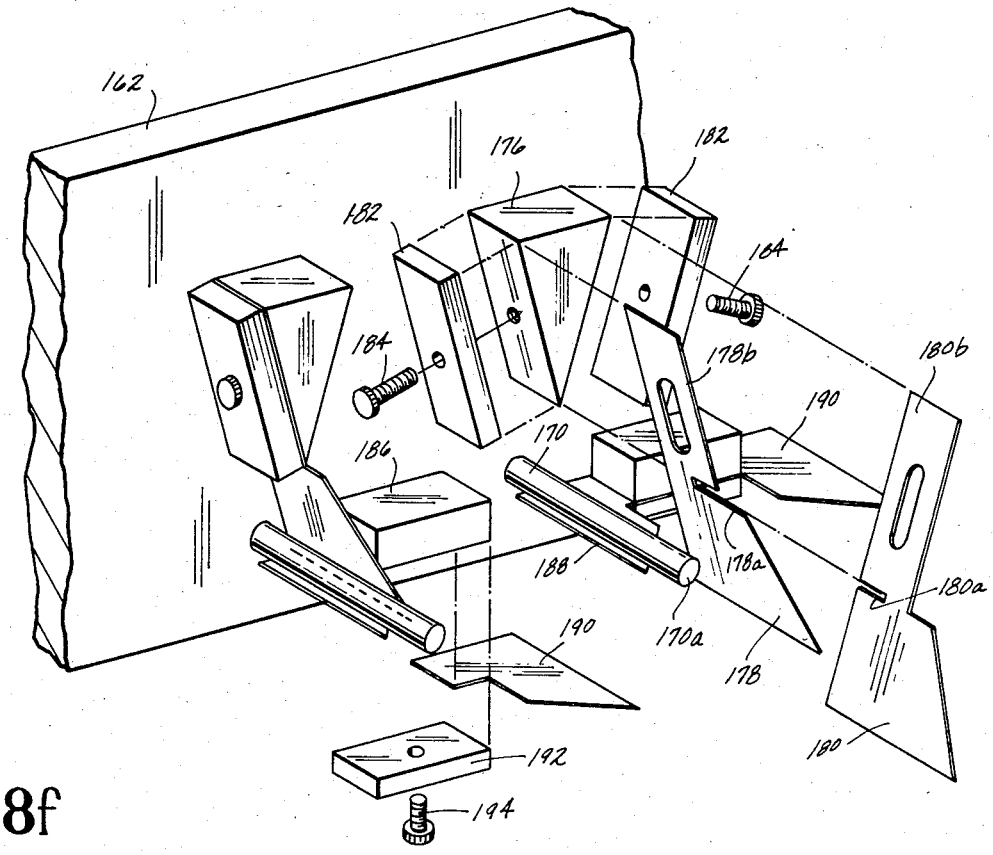
FIG. 8*f* is an exploded perspective view illustrating the manner in which the cutting blades are mounted on the cutting assembly illustrated in FIG. 8*d*.
Figure 8B:
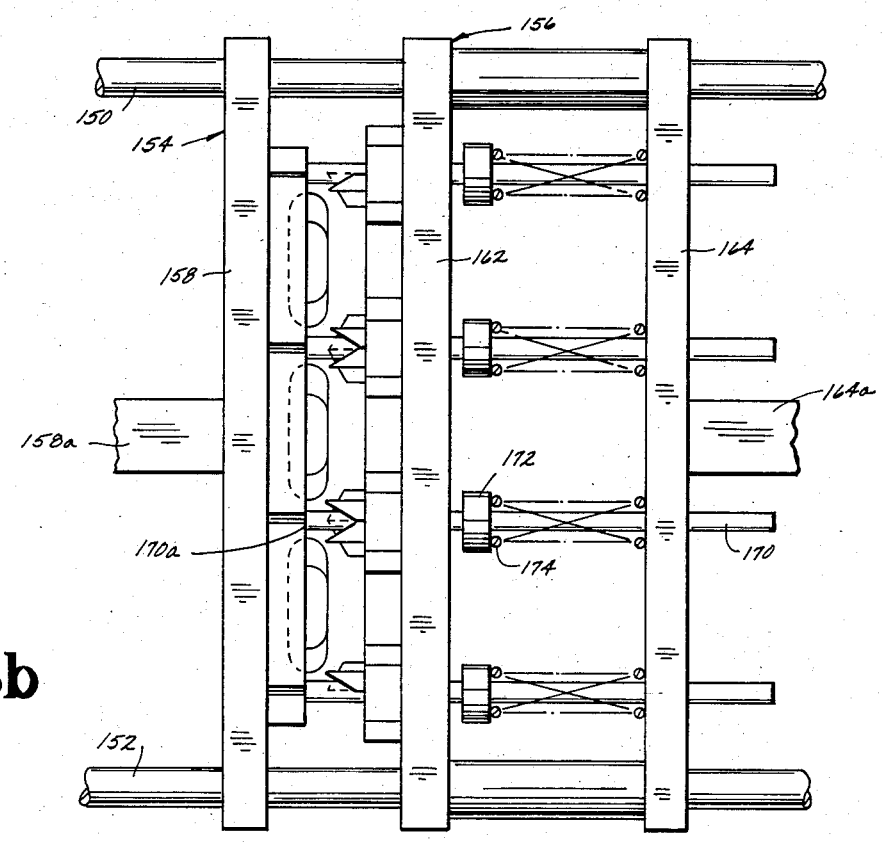
Figure 8C:
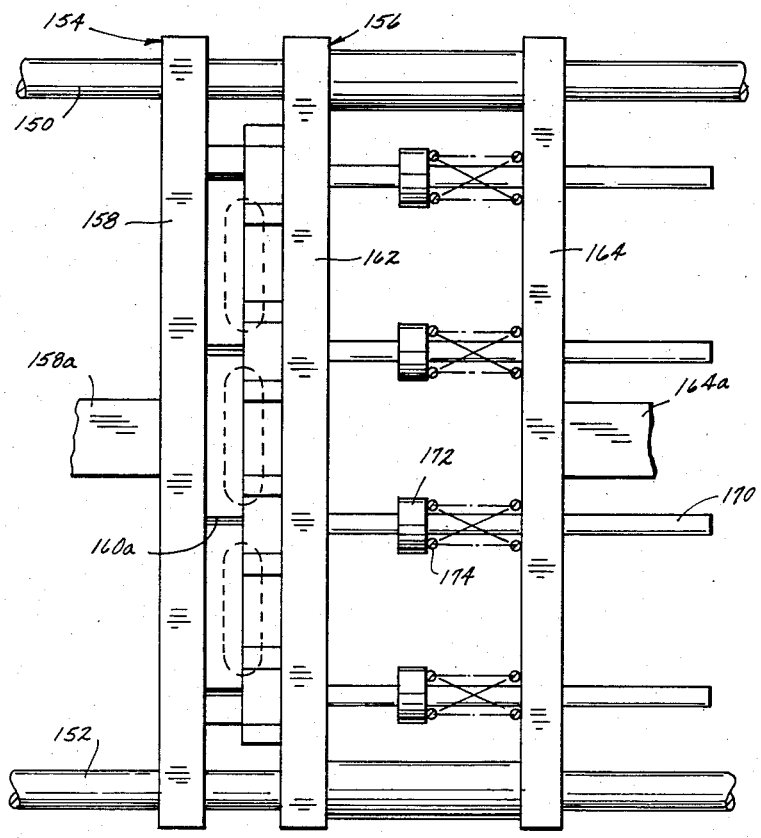
Figure 8D:
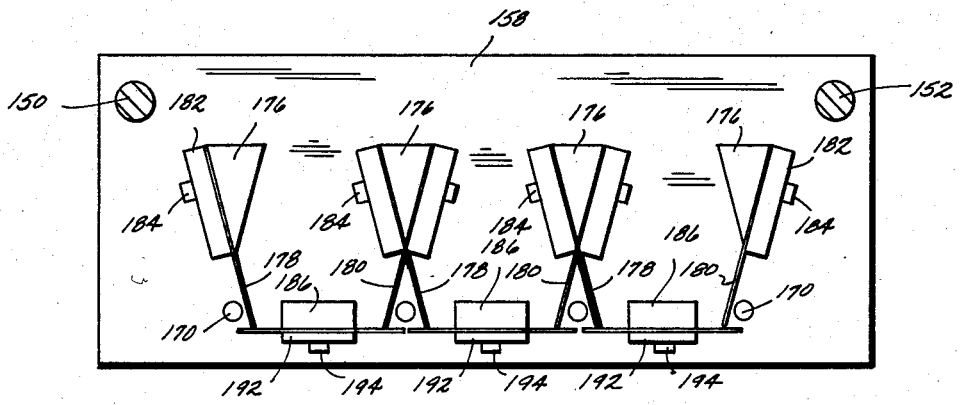
FIG. 8*d* is a sectional view taken along the line 8*d*—8*d* in FIG. 8*a* and illustrating the side of one of the cutting assemblies which faces the packet assembly.
Figure 8E:
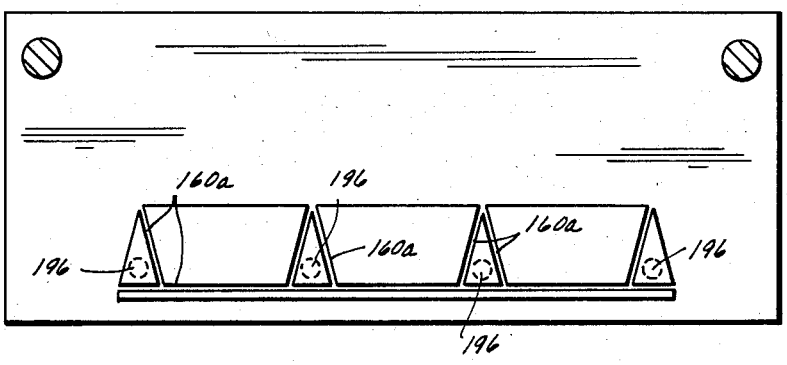
FIG. 8*e* is a sectional view taken along the line 8*e*—8*e* in FIG. 8*a* and illustrating the side of the other one of the cutting assemblies which faces the packet assembly.

As shown in FIGS. 8*d* and 8*f*, the one surface of the mounting plate has a plurality of V-shaped elements 176 for supporting a first plurality of cutting blades 178 angled in one direction relative to a vertical reference line and a second plurality of cutting blades 180 angled in the opposite direction relative to a vertical reference line. As shown in the exploded perspective view of FIG. 8*f*, the blades 178 and 180 are provided with cooperating interlocking slots 178*a* and 180*a* and upper tab portions 178*b* and 180*b* for securing the blades to the element 176 by means of plates 182 and fasteners 184. As shown in FIG. 8*d*, the leftmost element 176 supports only one of the blades 178, while the rightmost element 176 supports only one of the blades 180.

A plurality of horizontal elements 186 are positioned between each adjacent pair of blades 178 and 180. Each element 186 is utilized to support a pair of spaced apart horizontal cutting blades 188 and 190. As shown in FIG. 8*f*, the blades 188 and 190 can be secured to the mounting block 186 by means of a plate 192 and a fastener 194. The inclined blade 178 and the horizontal blade 188 cooperate to produce one of the cutout portions 34*a* and 34*b* shown in FIG. 2*d*, and the inclined blade 180 and the horizontal blade 190 cooperate to produce the other one of the cutout portions.

Initially, the components of the cutting assembly are in a position as shown in FIG. 8*a*. When a packet assembly has been positioned as shown in FIG. 8*a* between the first and second mechanisms by the carriage 12, the cutting mechanisms 154 and 156 are moved toward one another to the position shown in FIG. 8*b*, wherein the outer end portions 170*a* of the holding pins 170 contact the upper portions of the packets to hold the packets securely against the cutting block 160. More specifically, the holding pins 170 are adapted to securely hold the upper ends of the packet adjacent the circled phantom portions 196 shown on the cutting block 160 in FIG. 8*d*.

After the two mechanisms are in the position as shown in FIG. 8*b*, the first mechanism 154 will maintain its position on the guide shafts while the second mechanism 156 will continue to be moved toward the first mechanism 154 until the cutting blades have pierced the packaging material and have been received by the grooves 160*a* in the cutting block 160. As the second mechanism 156 is moved further toward the first mechanism 154, the holding pin 170 will remain stationary, causing the retaining rings 172 to compress the helical springs 174 and increase the holding force of the pins. After the upper corners of the packets have been cut, the two mechanism 154 and 156 can be retracted and the packet assembly will be of the form as illustrated in FIG. 2*d*.

Figure 9A:
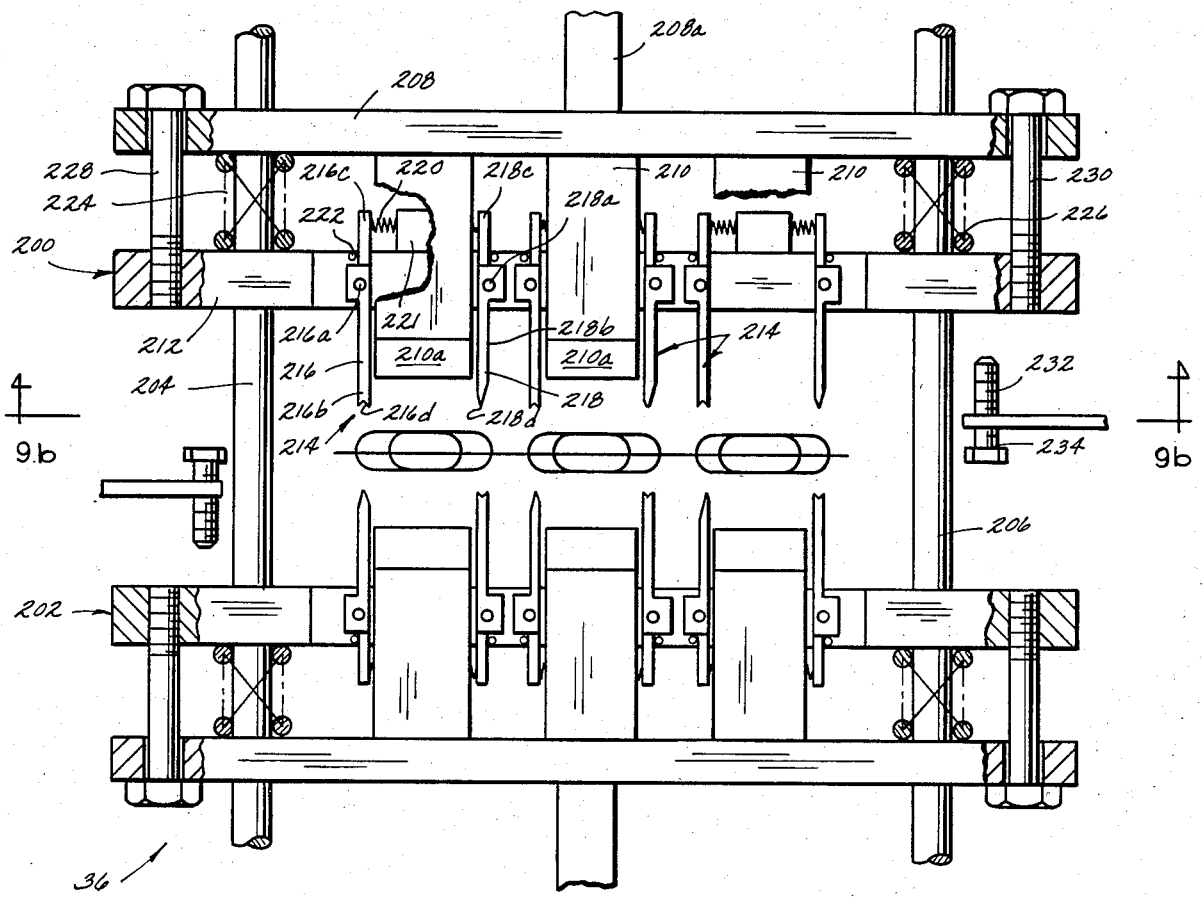
Figure 9B:
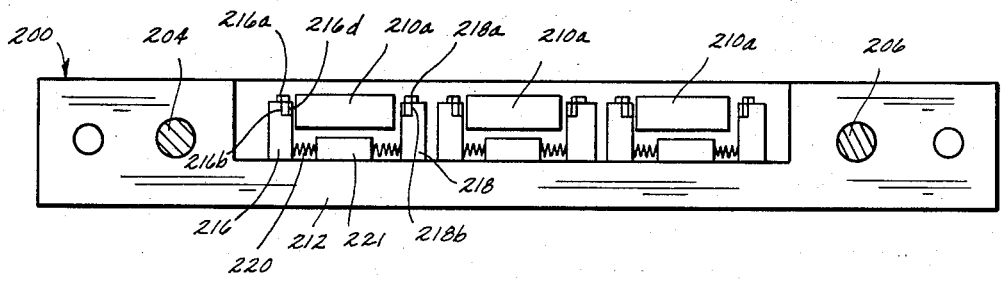
FIG. 9*b* is a sectional view taken along the line 9*d*—9*d* of FIG. 9*a* and illustrating the side of the one of the top sealing mechanism which faces the packet assembly.

Next, the carriage 12 transports the packet assembly to the top stretching and sealing station 36. The top stretching and sealing station 36 is shown in more detail in FIGS. 9*a* through 9*d*. As shown in FIG. 9*a*, the station 36 includes a pair of spaced apart, cooperating top stretching and sealing assemblies 200 and 202 which are similar in construction and are mounted for slidable movement toward and away from one another along guide shafts 204 and 206.

The assembly 200 includes a mounting plate 208 having a plurality of spaced apart arm members 210 each provided with a heated pressure sealing pad 210*a* on the outer end thereof for producing the top seal 40 shown on the packets in FIG. 2*f*. The opposite side of the plate 208 is connected to an actuating arm 208*a* adapted to be connected to a suitable drive mechanism (not shown) for controlling the position of the assembly 200 along the guide shafts 204 and 206.

The assembly 200 includes a second mounting plate 212 utilized to support a plurality of spaced apart stretching mechanisms 214 which are utilized to stretch the top of the packet, as shown in FIG. 2*e*, prior to the top sealing operation. Each of the stretching mechanisms includes a pair of stretcher elements 216 and 218 pivotally mounted to the plate 212 on opposite sides of each sealing pad 210*a* at 216*a* and 218*a* respectively. The stretcher element 216 includes a stretching arm 216*b* which extends in one direction past the outer end of the associated sealing pad 210*a* and a biasing arm 216*c* which extends in an opposite direction toward the mounting plate 212. As shown in FIG. 9*a*, a spring 220 is connected between the end of the biasing arm 216*c* and a block member 221 mounted on the plate 212 and functions to bias the outer end of the stretching arm 216*b* inwardly toward the associated sealing pad 210*a*. The inward pivotal movement of the stretching arm 216*b* is limited by an upstanding vertical stop pin 222 mounted in the plate 212. The stretcher element 218 is mounted on the plate 212 an biased toward the sealing pad 210*a* in a similar manner.

The outer end of each of the stretching arms 216*b* is provided with a V-shaped notch 216*d*, while the outer end of each of the stretching arms 218*b* is provided with a V-shaped projection 218*d*. As will be discussed, the V-shaped notches 216*d* of the stretching arms 216*b* of the assembly 200 cooperate with the V-shaped projections 218*d* on the stretching arms 218*b* of the assembly 202 to securely grasp the portion of the upper corners of the individual packets positioned between the respective arms.

A pair of helical springs 224 and 226 are positioned about the guide shafts 204 and 206 between the plates 208 and 212 for urging the plates away from one another. The spaced apart distance between the plates 208 and 212 is limited by means of bolts 228 and 230 which are slidably received within apertures formed in the plate 208 and threadedly secured within the plate 212. The inward movement of the plate 212 toward the packet assembly is limited by an adjusting screw 232 mounted within a plate 234 fixed relative to the main frame of the machine. As previously mentioned, the assembly 202 is similar in construction to the assembly 200.

Initially, the assemblies 200 and 202 are in the position as shown in FIG. 9*a*. When the carriage 12 has positioned the packet assembly between the cooperating assemblies as shown in FIG. 9*a*, the assemblies are moved toward one another. As the outer ends of the spreading arms 216*b* and 218*b* begin to contact the top portion of the packet assembly, the spreading arms 216*b* having V-shaped notches will receive the projecting V-shaped portions of the cooperating opposite spreading arms 218*b* and the upper portion of the packet will be securely held therebetween. Further inward movement of the assemblies 200 and 202 causes the spreading arms to pivot away from the associated sealing pad, thereby pulling the upper corners of the individual packets away from one another.

When the assemblies have been moved toward one another sufficiently such that the plate 212 contacts the one end of the adjusting screw 232, the inward movement of the plate 212 will stop, and the assemblies 200 and 202 will be in the position as shown in FIG. 9*c*, wherein the spreading arms have pulled the upper corners of the packet away from one another to cause the spaced apart upper marginal edge portions to move toward one another (as shown in FIG. 2*e*). At this point, the sealing pads 210*a* are still spaced from one another. As the assemblies continue to move inwardly, the plate 212 remains stationary and the springs 224 and 226 are compressed. The sealing pads 210*a* will then move into engagement with the upper portion of the sealing packets (as shown in FIG. 9*d*) to close the packets and produce a packet assembly as shown in FIG. 2*f*.

Once the top sealing operation has been completed, the packets are transported by the carriage 12 to the separation and release station 42 which is illustrated in FIGS. 10*a* through 10*d*. The station 42 includes a pair of spaced apart plates 240 and 242 mounted on a rotatable actuating shaft 244 coupled to a suitable drive mechanism (not shown). The plates have downwardly extending separation blades 240*a* and 242*a* mounted thereon. The station 42 includes release bar 250 coupled to a suitable actuating mechanism (not shown) and adapted to engage and pivot the release arms 108*a* and 110*a* of the clamping jaw members 108 and 110.

Figure 10A:
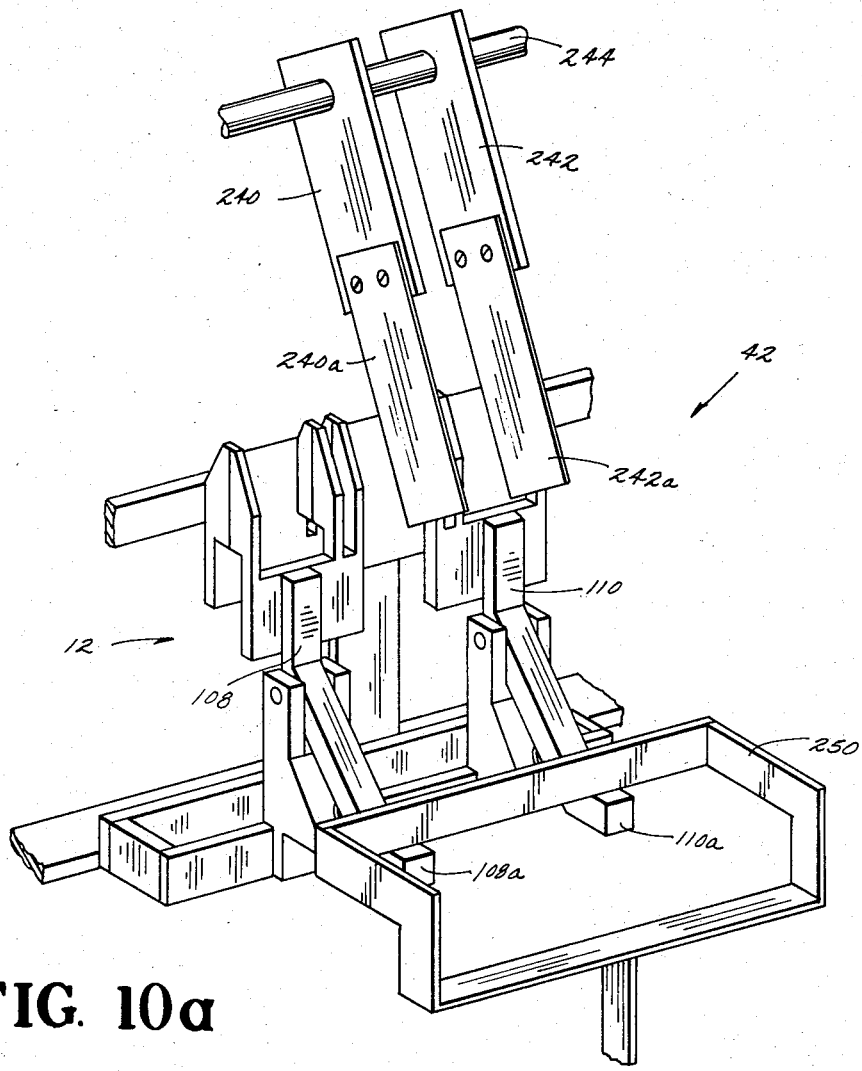
FIG. 10*a* is a perspective view illustrating the separation and release station of FIG. 1.
Figure 10B:
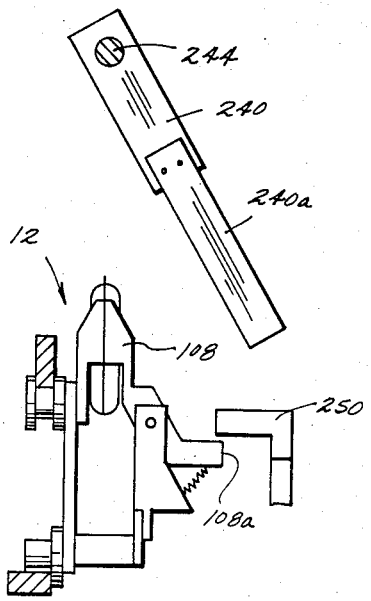
FIGS. 10*b*, 10*c*, and 10*d* illustrate the separation and release operation performed by the mechanism of FIG. 10*a*.
Figure 10C:
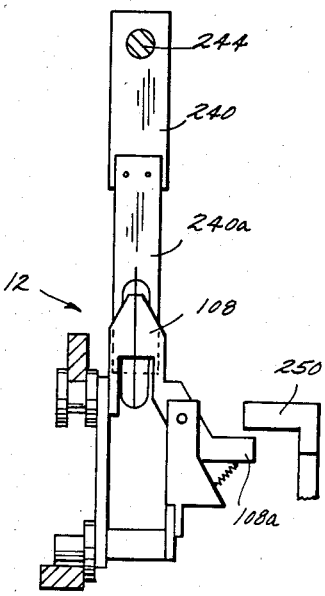
Figure 10D:
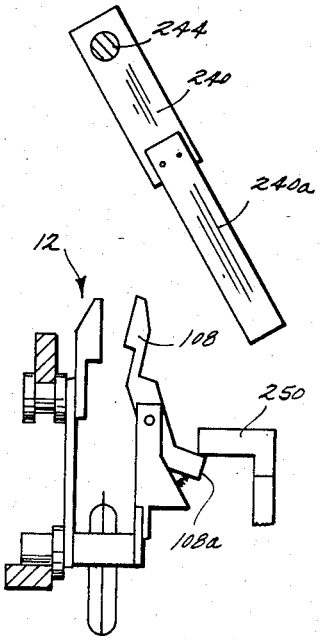

When the carriage 12 has positioned the sealed packet assembly such that the perforated lines 20*a* are in generally vertical alignment with the separation blades 240*a* and 242*a*, the actuating shaft 244 is rotated in one direction to cause the blades 240*a* and 242*a*, originally in the position as shown in FIG. 10*b*, to pass through the spaces between the clamping fingers as shown in FIG. 10*c*, and to separate the packets from one another along the perforated lines 20*a*. After the packets have been separated from one another, the blades 240*a* and 242*a* are retracted and the release bar 250 is moved downwardly, as shown in FIG. 10*d*, to release the individual packets from the carriage 12. The individual packets can be directed into a suitable shipping container (not shown) positioned below the removal station.

It should be noted that, while the foregoing description and the accompanying drawings have described and illustrated a machine for simultaneously producing three individual sealed packets, it will be appreciated that the method and apparatus of the present invention could readily be modified to produce a packet assembly having more or less individual packets.

In accordance with the provisions of the patent statutes, the principles and mode of operation of the present invention have been illustrated and described in what is considered to represent its preferred embodiment. However, it should be noted that the present invention may be practiced otherwise than as specifically illustrated and described without departing from its spirit or scope.

What is claimed is:

1. A method of packaging a product in at least two sealed packets, comprising the steps of:

(a) forming a generally U-shaped channel member having spaced apart generally vertical sidewalls from a flexible sheet of packaging material;

(b) sealing the facing surfaces of the sidewalls at horizontally spaced apart locations to define at least two open top packets connected together;

(c) introducing a product into each of the open top packets;

(d) pulling the upper corner portions of each of the connected together packets away from one another in a generally horizontal direction, thereby urging the upper marginal edges of the sidewalls of each of the packets toward one another; and (e) sealing the upper marginal edges of the packets together to close each packet.

2. The method according to claim 1 wherein step (b) includes the stop of maintaining the portions of the sidewalls located between the sealing locations in spaced apart relationship during the sealing operation.

3. The method according to claim 1 including the step of, prior to step (d), sealing the upper corner portions of the packets to reduce the size of the opening of each packet.

4. The method according to claim 1 wherein step (c) includes the step of maintaining the upper marginal edges in spaced apart relationship during the time when the product is introduced into each packet.

5. A method of packaging a product comprising the steps of:

(a) forming a generally U-shaped channel member having spaced apart generally vertical sidewalls from a flexible sheet of packaging material;

(b) sealing the facing surfaces of the sidewalls at horizontally spaced apart locations to define at least one open top packet;

(c) introducing a product into the open top packet;

(d) subsequent to step (c), sealing the upper corner portions of the open top packet to reduce the size of opening of the packet;

(e) pulling the upper sealed corner portions of the packet away from one another in a generally horizontal direction, thereby urging the upper marginal edges of the packet toward one another; and (f) sealing the upper marginal edges of the packet together to close the packet.

6. The method according to claim 5 wherein step (b) includes the step of maintaining the portion of the sidewalls located between each pair of sealing locations defining one of the packets in spaced apart relationship during the sealing operation.

7. The method according to claim 5 wherein step (c) includes the step of maintaining the upper marginal edges of each of the packets in spaced apart relationship during the time when the product is introduced into the packets.

8. A method of packaging a product in at least two sealed packets, comprising the steps of:

(a) forming at least one longitudinally extending perforated line in a sheet of flexible packaging material as the sheet is moved in a longitudinal direction to a predetermined position;

(b) forming the sheet into a U-shaped channel having spaced apart generally vertical sidewalls with the perforated line located in said vertical sidewalls;

(c) sealing the facing surfaces of the sidewalls at horizontally spaced apart locations along the channel to define at least two open top packets connected by the perforated line;

(d) introducing a product into each of the open top packets; and (e) sealing the upper marginal edges of the packets to close the packets.

9. The method according to claim 8 including the step of separating the packets from one another along the perforated line.

10. An apparatus for packaging a product in at least two sealed packets comprising, in combination:

forming means for forming a sheet of flexible packaging material into a generally U-shaped channel member having spaced apart generally vertical sidewalls;

side sealing means for sealing the facing surfaces of said sidewalls at horizontally spaced apart locations to define at least two open top packets connected together;

filling means for introducing a product into said open top packets;

means for pulling the upper corner portions of said connected packets away from one another in a generally horizontal direction, thereby urging the upper marginal edges of said packets toward one another; and top sealing means for sealing the upper marginal edges of said packets together to close said connected packets.

11. The apparatus according to claim 10 wherein said side sealing means, said filling means, and said top sealing means are horizontally spaced from one another, and carriage means for transporting said packet from said side sealing means to said filling means and from said filling means to said top sealing means.

12. The apparatus according to claim 11 wherein said side sealing means is spaced from said carriage means, and means for transferring said packet from said side sealing means to said carriage means.

13. The apparatus according to claim 10 including a supply of flexible packaging material, means for feeding said material in a generally horizontal direction to a predetermined position, and means for severing a predetermined length of said material to produce said sheet of flexible packaging material.

14. The apparatus according to claim 10 wherein said side sealing means includes means for maintaining the intermediate portions of said sidewalls located between the sealing locations in spaced apart relationship during the side sealing operation.

15. The apparatus according to claim 10 including means for sealing the upper corner portions of said packet prior to pulling the upper corner portions away from one another.

16. The apparatus according to claim 10 wherein said filling means includes means for maintaining the upper marginal edges of said packet in spaced apart relationship during the time when the product is introduced into said packet.

17. An apparatus for packaging a product in a packet comprising, in combination:

forming means for forming a sheet of flexible packaging material into a generally U-shaped channel member having spaced apart generally vertical sidewalls;

side sealing means for sealing the facing surfaces of said sidewalls at horizontally spaced apart locations to define at least one open top packet;

filling means for introducing a product into said open top packet;

sealing means for sealing the upper corner portion of the open top packet for reducing the size of the opening of the open top packet;

means for pulling the upper sealed corner portions of said packet away from one another, thereby urging the upper marginal edges of said packet toward one another; and top sealing means for sealing the upper marginal edge portions of said packet together to close the packet.

18. The apparatus according to claim 16 wherein said side sealing means, said filling means, and said top sealing means are horizontally spaced from one another, and carriage means for transporting said packets from said side sealing means to said filling means and from said filling means to said top sealing means.

19. The apparatus according to claim 18 wherein said side sealing means is spaced from said carriage means, and means for transferring said packets from said side sealing means to said carriage means.

20. The apparatus according to claim 17 including a supply of flexible packaging material, means for feeding said material in a generally horizontal direction to a predetermined position, and means for severing a predetermined length of said material to produce said sheet of flexible packaging material.

21. The apparatus according to claim 17 wherein said side sealing means includes means for maintaining the intermediate portions of said sidewalls located between the sealing locations in spaced apart relationship during the side sealing operation.

22. The apparatus according to claim 17 including means for sealing the upper corner portions of said packets prior to pulling the upper corner portions away from one another.

23. The apparatus according to claim 17 wherein said filling means includes means for maintaining the upper marginal edges of said packet in spaced apart relationship during the time when the product is introduced into said packets.

24. An apparatus for packaging a product in at least two sealed packets comprising, in combination:

perforation means for forming at least one longitudinally extending perforated line in a sheet of flexible packaging material moving along a longitudinal direction to a predetermined position;

means for forming said sheet into a U-shaped channel having spaced apart generally vertical sidewalls with said perforated line located in said vertical sidewalls;

means for sealing the facing surface of said sidewalls at selected horizontally spaced apart locations along said channel to define at least two open top packets connected by said perforated line;

means for introducing a product into each of said open top packets; and means for sealing the upper marginal edges of said packets to close said packets.

25. The apparatus according to claim 24 including a supply of flexible packaging material, means for feeding said material in a generally horizontal direction to a predetermined position, and means for severing a predetermined length of said material to produce said sheet of flexible packaging material.

26. The apparatus according to claim 25 wherein said perforation means is positioned to form said perforated line prior to severing said sheet from said supply of flexible packaging material.

27. The apparatus according to claim 24 including means for separating said packets from one another along said perforated lines.

* * * * *